US006204768B1

(12) United States Patent
Kosugi et al.

(10) Patent No.: US 6,204,768 B1
(45) Date of Patent: Mar. 20, 2001

(54) FIRE MONITORING SYSTEM AND FIRE SENSOR

(75) Inventors: Naoki Kosugi; Masayuki Ito, both of Tokyo (JP)

(73) Assignee: Hochiki Corporation, Tokyo (JP)

( * ) Notice: Subject to any disclaimer, the term of this patent is extended or adjusted under 35 U.S.C. 154(b) by 0 days.

(21) Appl. No.: 09/427,070

(22) Filed: Oct. 26, 1999

(30) Foreign Application Priority Data

Oct. 30, 1998 (JP) ..... 10-310152

(51) Int. Cl.[7] ..... G08B 17/12

(52) U.S. Cl. ..... 340/577; 340/506; 340/505; 340/517; 340/521; 340/523

(58) Field of Search ..... 340/506, 505, 340/508, 511, 517, 521, 522, 523, 577, 584, 628, 632, 286.01, 286.02

(56) References Cited

U.S. PATENT DOCUMENTS 5,017,905 * 5/1991 Yuchi ..... 340/506
5,117,219 * 5/1992 Tice et al. ..... 340/505
5,128,653 * 7/1992 Yuchi ..... 340/506
5,428,343 * 6/1995 Kikuchi et al. ..... 340/518
5,635,904 * 6/1997 Takahashi et al. ..... 340/506
5,654,690 * 8/1997 Ishikawa et al. ..... 340/506

FOREIGN PATENT DOCUMENTS 2 183 379 6/1987 (GB) ..... H04Q/9/00

* cited by examiner

*Primary Examiner*—Benjamin C. Lee
*Assistant Examiner*—Daniel Previl
(74) *Attorney, Agent, or Firm*—Sughrue, Mion, Zinn, Macpeak & Seas, PLLC

(57) ABSTRACT

A multi-sensor type sensor has sensor processors for generating detection data of plural types based on detection signals from a plurality of sensor portions, and a mode switching portion for switching a mode which indicates type of data to be sent to a receiver in response to a mode switching instruction issued from the receiver, and sending selectively the data of the type which corresponds to a current switching mode in response to a data request instruction issued from the receiver. The receiver includes a mode switching indicating portion for switching the mode by transmitting the mode switching instruction which selects type of response data to the fire sensors, and a fire judging portion for judging the fire by receiving the response data from the fire sensors in response to transmission of the data request instruction.

14 Claims, 19 Drawing Sheets

FIG. 17A

| | | TEMPERATURE DIFFERENCE ΔT (°C) | | | |
|---|---|---|---|---|---|
| | | BELOW 5.5°C | 5.5°C ≤ ΔT < 13.0°C | 13.0°C ≤ ΔT < 20.5°C | OVER 20.5°C |
| EXTERNAL TEMPERATURE To (°C) | BELOW 40.0°C | 1.0 | 1.0 | 1.0 | 1.0 |
| | 40.0°C ≤ To < 50.0°C | 1.0 | 1.1 | 1.2 | 1.3 |
| | 50.0°C ≤ To < 60.0°C | 1.0 | 1.2 | 1.3 | 1.4 |
| | 60.0°C ≤ To < 70.0°C | 1.0 | 1.3 | 1.4 | 1.5 |
| | 70.0°C ≤ To < 80.0°C | 1.0 | 1.0 | 1.4 | 1.5 |
| | OVER 80.0°C | 1.0 | 1.0 | 1.5 | 1.6 |

FIG. 17B

| | | TEMPERATURE DIFFERENCE ΔT (°C) | | | |
|---|---|---|---|---|---|
| | | BELOW 5.5°C | 5.5°C ≤ ΔT < 13.0°C | 13.0°C ≤ ΔT < 20.5°C | OVER 20.5°C |
| EXTERNAL TEMPERATURE To (°C) | BELOW 40.0°C | NO CORRECTION | NO CORRECTION | NO CORRECTION | NO CORRECTION |
| | 40.0°C ≤ To < 50.0°C | NO CORRECTION | 1.1 | 1.2 | 1.3 |
| | 50.0°C ≤ To < 60.0°C | NO CORRECTION | 1.2 | 1.3 | 1.4 |
| | 60.0°C ≤ To < 70.0°C | NO CORRECTION | 1.3 | 1.4 | 1.5 |
| | 70.0°C ≤ To < 80.0°C | NO CORRECTION | NO CORRECTION | 1.4 | 1.5 |
| | OVER 80.0°C | NO CORRECTION | NO CORRECTION | 1.5 | 1.6 |

FIG. 18A

| | | TEMPERATURE DIFFERENCE ΔT (°C) | | | |
|---|---|---|---|---|---|
| | | BELOW 5.5°C | 5.5°C ≤ ΔT < 13.0°C | 13.0°C ≤ ΔT < 20.5°C | OVER 20.5°C |
| EXTERNAL TEMPERATURE To (°C) | BELOW 40.0°C | NO CORRECTION | NO CORRECTION | NO CORRECTION | NO CORRECTION |
| | 40.0°C ≤ To < 50.0°C | NO CORRECTION | 28 | 29 | 30 |
| | 50.0°C ≤ To < 60.0°C | NO CORRECTION | 31 | 32 | 33 |
| | 60.0°C ≤ To < 70.0°C | NO CORRECTION | 34 | 35 | 36 |
| | 70.0°C ≤ To < 80.0°C | NO CORRECTION | NO CORRECTION | 37 | 38 |
| | OVER 80.0°C | NO CORRECTION | NO CORRECTION | 39 | 40 |

FIG. 18B

76

| ADDRESS | CORRECTION FACTOR | TEMPERATURE DIFFERENCE |
|---|---|---|
| 28 | 1.1 | 6 |
| 29 | 1.2 | 13 |
| 30 | 1.3 | 21 |
| 31 | 1.2 | 6 |
| 32 | 1.3 | 13 |
| 33 | 1.4 | 21 |
| 34 | 1.3 | 6 |
| 35 | 1.4 | 13 |
| 36 | 1.5 | 21 |
| 37 | 1.4 | 13 |
| 38 | 1.5 | 21 |
| 39 | 1.5 | 13 |
| 40 | 1.6 | 21 |

FIG. 18C

76

| ADDRESS | CORRECTION FACTOR | TEMPERATURE DIFFERENCE |
|---|---|---|
| 28 | 141 | 6 |
| 29 | 154 | 13 |
| 30 | 166 | 21 |
| 31 | 154 | 6 |
| 32 | 166 | 13 |
| 33 | 179 | 21 |
| 34 | 166 | 6 |
| 35 | 179 | 13 |
| 36 | 192 | 21 |
| 37 | 179 | 13 |
| 38 | 192 | 21 |
| 39 | 192 | 13 |
| 40 | 205 | 21 |

FIRE MONITORING SYSTEM AND FIRE SENSOR

BACKGROUND OF THE INVENTION

1. Field of the Invention

The present invention relates to a fire monitoring system and fire sensors, which are capable of judging a fire by connecting a plurality of fire sensors to a receiver via a transmission line and then transmitting detection data from the plurality of fire sensors repeatedly in the predetermined order in response to respective instructions issued from the receiver. More particularly, the present invention relates to a fire monitoring system and fire sensors, which are capable of sending plural types of detection data selectively from the fire sensor by providing a plurality of sensors in the fire sensor.

2. Description of the Related Art

Conventionally, in the fire monitoring system which monitors a plurality of fire sensors concentratively by a receiver, the so-called multi-sensor type fire sensors each of which has functions of detecting smoke and heat are connected to the receiver via a transmission line.

According to such multi-sensor type fire sensor, when a smoke sensing circuit and a heat sensing circuit are provided such fire sensor, they can be switched according to the instruction issued from the receiver to operate individually (Unexamined Japanese Patent Publication (KOKAI) Hei 7-65263 (JP-A-7-65263)).

Therefore, the fire sensor can be operated as the smoke sensor or the smoke sensor according to the situations such as an installing location. In addition, if the fire is detected in the situation that the fire sensor is switched to the smoke sensing circuit, a false alarm can be prevented beforehand by switching the fire sensor to the heat sensing circuit to check the fire.

However, according to the fire sensor in which the smoke sensing circuit and the heat sensing circuit are switched according to the instruction issued from the receiver, there has been such a problem that a circuit configuration becomes complicated since a switching circuit is provided as a hardware to switch them. In addition, there has been another problem that, since two sensing circuits are switched so as to operate one of them and terminate the other, merely one of two sensing circuits can operate not to utilize plural types of detecting functions as a feature of the fire sensor.

Further, if the smoke sensing circuit and the heat sensing circuit are switched by allocating different addresses to respective sensing circuits, both sensing functions can be utilized by switching the address for the data request instruction. However, a plurality of addresses must be allocated to one fire sensor, nevertheless the maximum number of addresses which can be allocated to the fire sensors by the receiver is limited. As a result, there has been a problem that, since the number of address becomes insufficient, the number of the fire sensors which can be connected to the receiver is reduced.

SUMMARY OF THE INVENTION

It is an object of the present invention to provide a fire monitoring system and fire sensors, which are capable of monitoring a fire appropriately by utilizing plural types of sensor functions such as smoke and heat sensing functions effectively without complication of circuit configuration and lack of address.

The present invention is directed to a fire monitoring system which can detect a fire by connecting a plurality of fire sensors to a receiver via a transmission line and then transmitting detection data from the plurality of fire sensors repeatedly in predetermined order in response to instructions from the receiver.

In such fire monitoring system of the present invention, each of the fire sensors includes a plurality of sensor portions of different types, sensor processors for outputting detection data of plural types based on detection signals from the plurality of sensor portions, and a mode switching portion for switching a mode which corresponds to detection data to be sent in response to a mode switching instruction from the receiver and sending selectively the detection data which corresponds to a current switching mode in response to a data request instruction from the receiver.

Also, the receiver includes a mode switching indicating portion for switching the mode by transmitting the mode switching instruction which selects type of response data to the fire sensors, and a fire judging portion for judging the fire by receiving the response data from the fire sensors in response to transmission of the data request instruction.

In such fire monitoring system of the present invention, the plurality of sensor portions such as the heat sensor portion, the smoke sensor portion, etc., which are provided to each of the fire sensors, are not switched, but merely the mode of the fire sensors is switched to correspond to detection data which is to be sent to the receiver, in answer to the mode switching instruction issued from the receiver since such plurality of sensor portions are always detecting the smoke data and the temperature data in the normal operation state.

As a result, switching of the plurality of sensor portions by using the hardware is not needed, and the address must be set simply in one unit of the fire sensor. Therefore, reduction in the connection number of the fire sensors, due to lack of the address caused when the address must be set for every type of data, does not happen.

Therefore, each of the fire sensors according to the present invention includes, as the plurality of sensor portions, a smoke sensor portion for detecting a smoke generated by the fire to output a smoke signal, and a heat sensor portion for detecting heat radiated by the fire to output a temperature signal, and includes, as the sensor processors, a smoke sensor data processor for converting the smoke signal into smoke data responding to the receiver and then holding the smoke data, a temperature sensor data processor for converting the temperature signal into temperature data responding to the receiver and then holding the temperature data, and a multi-sensor data processor for correcting the smoke signal based on the temperature signal to convert the smoke signal into corrected smoke data responding to the receiver and then holding the corrected smoke data.

Further, the mode switching portion of each of the fire sensors has switching functions of a smoke sensor mode to send the smoke data, a temperature sensor mode to send the temperature data, and a multi-sensor mode to send the corrected smoke data, and then switches the mode into one of the smoke sensor mode, the temperature sensor mode, and the multi-sensor mode based on the mode switching instruction issued from the receiver.

The mode switching portion of each of the fire sensors sends data corresponding to a current switching mode when it receives the data request instruction which does not designate a particular mode from the receiver. This corresponds to data collection from the fire sensor using the normal polling command after the mode has been switched, so that the data which has the type fixed in the mode after switching can be collected.

The mode switching portion of each of the fire sensors sends data in a designated mode irrespective of a current switching mode when it receives the data request instruction designating a particular mode from the receiver. This corresponds to the case where data in the mode other than the current switching mode would be collected in the normal polling, so that the data in the mode designated by the command can be collected irrespective to the current switching mode.

For example, if the fire sensor has been currently switched into the multi-sensor mode, the concerned detection data can be collected by designating the smoke mode or the heat mode from the receiver as the case may be. If the fire or the fault is detected based on the data in the multi-sensor mode, for example, this function makes it possible to judge the fire or the fault more precisely by collecting the detection data in the smoke mode or the heat mode as the different mode.

The mode switching portion of each of the fire sensors initializes the multi-sensor mode when the power supply is turned on. This initialization mode is a basic employment of the system, and thus other modes may be set.

Each of the fire sensors further comprises an interruption processor for transmitting an interruption signal to the receiver when the smoke data, the temperature data, or the corrected smoke data exceeds a predetermined threshold value, and the fire judging portion of the receiver transmits an interruption retrieval instruction so as to retrieve each of the fire sensors which has transmitted an interruption signal when it receives an interruption signal from each of the fire sensors and collects the detection data sequentially by sending the data request instruction to the retrieved fire sensor repeatedly.

The early detection of the fire can be achieved by monitoring the sensor concentratively after the abnormality has been quickly detected on the receiver side based on the interruption issued from such fire sensor. In this case, the interruption function of the fire sensor is provided in all modes.

The mode switching indicating portion of the receiver switches the mode of a particular fire sensor by designating the address of the particular fire sensor. Otherwise, the mode switching indicating portion of the receiver switches the mode of all fire sensors by designating a polling address common to all fire sensors. In other words, if all the fire sensors connected to a system as unit of the polling by the receiver are composed of the fire sensors of the present invention, switching of the mode can be carried out by designating the address individually or designating the common polling command. On the contrary, if the fire sensors of the present invention as well as the ordinary fire sensors are connected to the system as unit of the polling by the receiver, the mode of the fire sensors can be switched into the mode being designated by the address.

The mode switching indicating portion of the receiver switches a current mode which has fault into other normal modes when it detects the fault in each of the fire sensors. Consequently, a fail-safe function for avoiding trouble of the fire sensor so as to collect the normal data can be achieved.

Further, the multi-sensor data processor of each of the fire sensors includes a temperature difference detecting portion for detecting a temperature difference which represents a rate of temperature rise when it receives heat generated by the fire, a correction factor deciding portion for deciding a correction factor for the smoke signal based on the external temperature and the temperature difference, and a smoke signal correcting portion for correcting the smoke signal by multiplying the smoke signal by the correction factor.

According to this the multi-sensor data processor, the correction factor is decided by using both the current external temperature and the rate of the temperature rise and then the smoke signal is corrected by using the correction factor. Therefore, the fire which has not been able to be detected only by the smoke, e.g., the flaming fire in which the smoke density is low but the temperature is rapidly increased, can be detected without fail. Also, since the smoke detection sensibility can be set lower in the normal circumstance in which change in the temperature is small, a probability of generation of the non-fire alarm can be reduced. Especially, if the sensor receives directly the hot air from the space heater, etc., in the normal circumstance state, the temperature rise is seldom caused after the temperature has come up to a certain temperature. As a result, the smoke detection sensibility can be set lower and thus above situation is never judged as the fire even if the temperature is high.

The correction factor deciding portion of the multi-sensor processing portion divides the external temperature To and the temperature difference $\Delta T$ into a plurality of temperature ranges each having a predetermined temperature width respectively, then previously sets the correction factor K to each temperature range of the temperature difference $\Delta T$ so as to increase substantially in proportion to an increase of the temperature difference $\Delta T$ if the external temperature To belongs to the same temperature range, then previously sets the correction factor K to each temperature range of the external temperature To so as to increase substantially in proportion to rise of the external temperature To if the temperature difference $\Delta T$ belongs to a same temperature range, and then decides a previously set correction factor K based on the temperature range to which the external temperature To detected by the external temperature detecting portion belongs and the temperature range to which the temperature difference $\Delta T$ calculated by the temperature difference calculating portion belongs.

The correction factor deciding portion of the multi-sensor processing portion varies the correction factor K substantially by changing the temperature range of the external temperature To and/or the temperature range of the temperature difference $\Delta T$ while fixing the previously set correction factor itself, otherwise varies the correction factor K itself while fixing the temperature range of the external temperature To and the temperature range of the temperature difference $\Delta T$.

The correction factor deciding portion of the multi-sensor processing portion decides the correction factor K of 1.0 and does not substantially correct the smoke signal by the smoke signal correcting portion if the external temperature To is below a first predetermined temperature, if the temperature difference $\Delta T$ is below a first predetermined temperature difference, or if the external temperature To is more than a second predetermined temperature and the temperature difference $\Delta T$ is less than a second predetermined temperature difference.

BRIEF DESCRIPTION OF THE DRAWINGS

In the accompanying drawings:

FIGS. 17A and 17B are views showing correction factor tables employed to decide a correction factor in the present invention;

FIGS. 18A to 18C are views showing an address table and memory correction factor tables to implement the correction factor tables shown in FIG. 17;

PREFERRED EMBODIMENT OF THE INVENTION

Preferred embodiment according to the present invention will be described referring to the accompanying drawings as follows.

Figure 1:
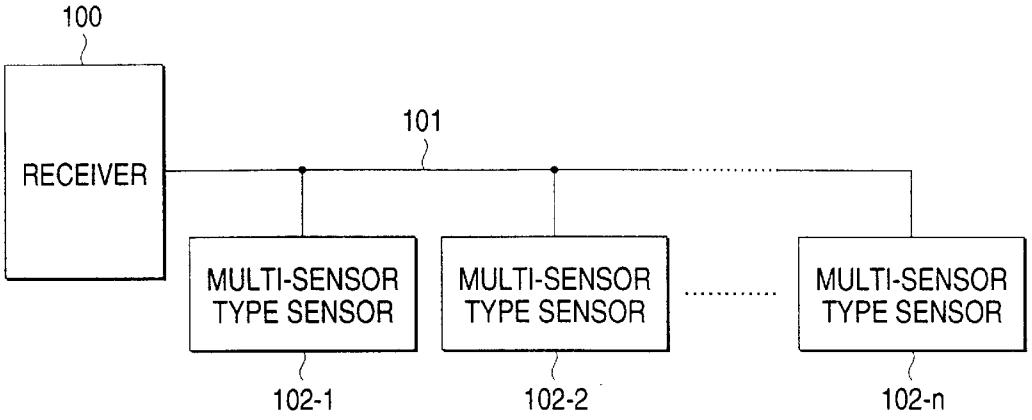
FIG. 1 is ablock diagram showing a fire monitoring system of the present invention in which only fire sensors of the present invention are connected to a transmission line.

FIG. 1 is a block diagram showing an overall configuration of a fire monitoring system of the present invention. In FIG. 1, a transmission line 101 is provided to extend from a receiver 100 which is placed in a building manager's room, etc., and then multi-sensor type sensors 102-1, 102-2, . . . , **102-*n* according to the present invention are connected to the transmission line 101**.

Each of the multi-sensor type sensors 102-1, 102-2, . . . , **102-*n* includes a smoke sensor portion and a heat sensor portion, for example, and then generates plural types of detection data based on detection data and also transmits the detection data in response to the data request instruction issued from the receiver 100. Here, types of data which the multi-sensor type sensors 102-1, 102-2, . . . , 102-*n*** can send are set to three, i.e., (1) smoke data, (2) heat data, and (3) multi-sensor data.

As made clear by the later explanation, the multi-sensor data are corrected data which are derived by correcting the smoke data based on temperature data. In compliance to three types of such data, each of the multi-sensor type sensors 102-1, 102-2, . . . , **102-*n*** can switch following three modes.

(1) smoke sensor mode, (2) heat sensor mode, and (3) multi-sensor mode.

A mode switching which decides type of response data for the multi-sensor type sensors 102-1, 102-2, . . . , **102-*n* is executed based on the mode switching instruction from the receiver 100. In this embodiment, at the time of power-on when a power is supplied to the multi-sensor type sensors 102-1, 102-2, . . . , 102-*n* via the transmission line 101 by turning on the power supply in the receiver 100, the multi-sensor mode is initialized, then the data are collected in this multi-sensor mode according to the polling by which the receiver 100 can designate the addresses of the multi-sensor type sensors 102-1, 102-2, . . . , 102-*n***.

When the fire is caused, the multi-sensor type sensor 102-1, for example, transmits an interruption signal to the receiver 100. Regardless of mode switching, the interruption signal is transmitted to the receiver 100 in answer to this interruption when the smoke data, the heat data, or the multi-sensor data exceeds a predetermined threshold value.

The receiver 100, when receives the interruption signal, can transmit an interruption retrieval instruction to the transmission line 101 and then identify the multi-sensor type sensor 102-1 as an interrupter which has issued the interruption signal. If the receiver 100 has been able to identify the multi-sensor type sensor 102-1 as the interrupter, it reads data concentratively from the multi-sensor type sensor 102-1 by designating the address, then judges generation of the fire when the data reach predetermined threshold levels which are set higher than pre-alarm levels to decide the fire, and then generates the fire alarm or executes the fire preventing process.

Figure 2:
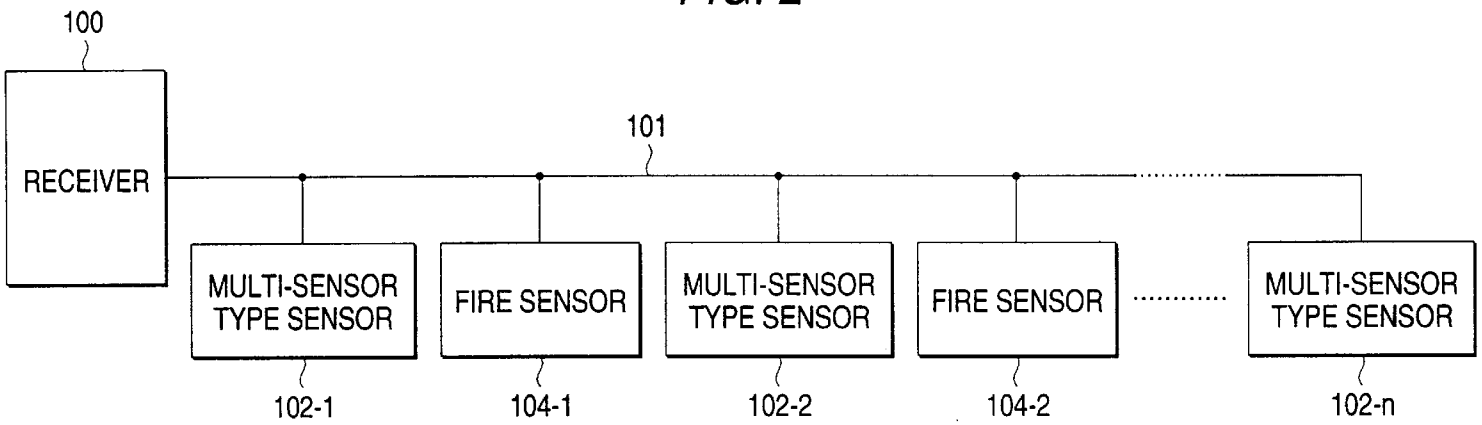
FIG. 2 is a block diagram showing a fire monitoring system of the present invention in which the fire sensors of the present invention and existing fire sensors are connected to the transmission line.

FIG. 2 shows another embodiment of the fire monitoring system of the present invention in which, in this case, existing fire sensors 104-1, 104-2, . . . other than the multi-sensor type sensor 102-1, 102-2, . . . , **102-*n* of the present invention are connected to the transmission line 101 being extended from the receiver 100. Therefore, the mode switching effected by the receiver 100 is applied only to the multi-sensor type sensors 102-1, 102-2, . . . , 102-*n*** according to the present invention.

In the case in FIG. 1, when the fire monitoring system in FIG. 1 in which only the multi-sensor type sensor 102-1, 102-2, . . . , **102-*n* of the present invention are connected is compared with the mixed type fire monitoring system in which the existing fire sensor 104-1, 104-2, . . . are also connected, it is apparent that the mode switching can be achieved by the mode switching instruction by which a common polling command is issued from the receiver 100 to all the multi-sensor type sensor 102-1, 102-2, . . . , 102-*n***.

In contrast, in the case in FIG. 2, the mode switching executed by the mode switching instruction which designates the addresses of the multi-sensor type sensor 102-1, 102-2, . . . , **102-*n* of the present invention except for the existing fire sensor 104-1, 104-2**, . . . is needed.

Figure 3:
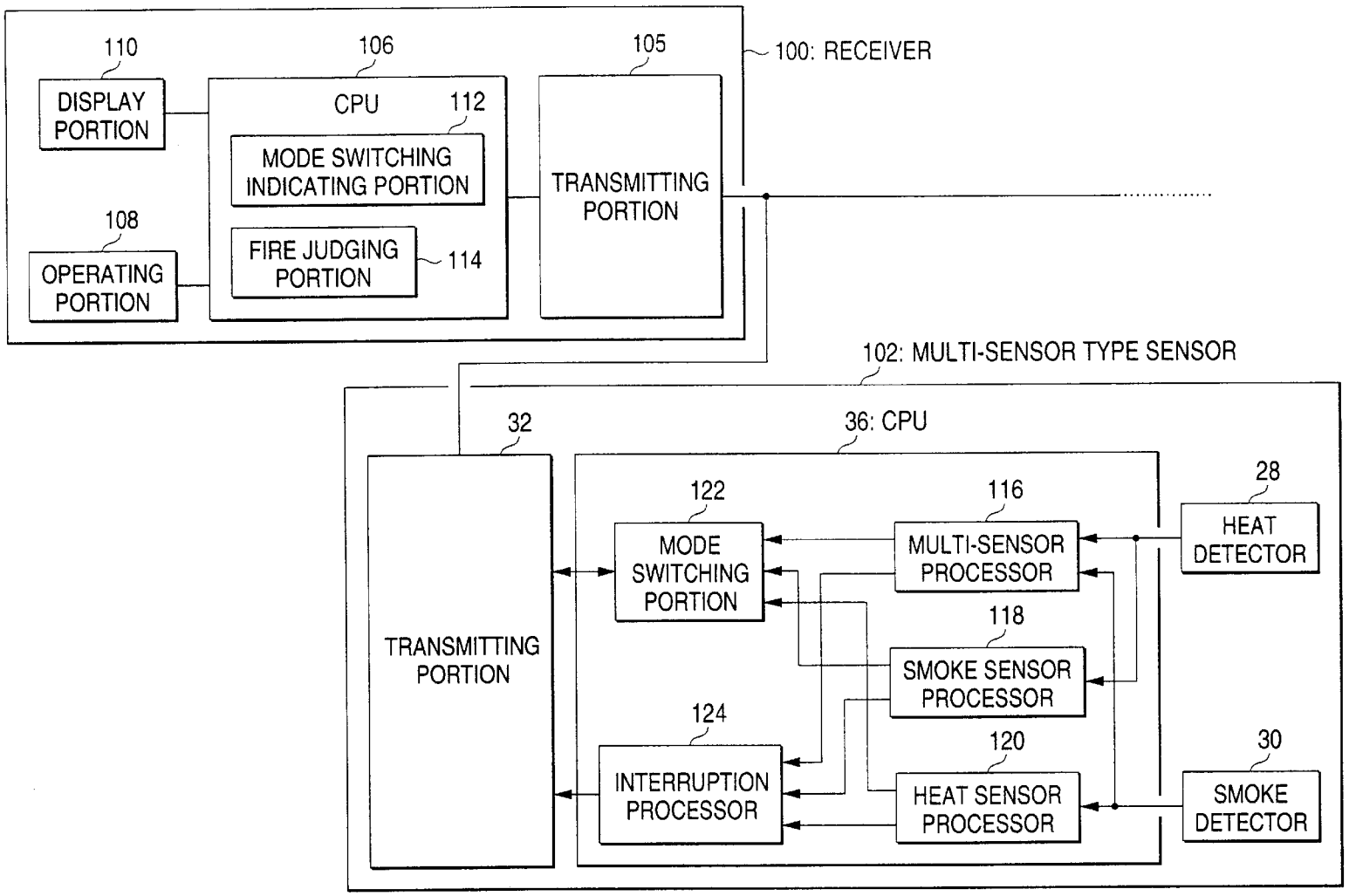
FIG. 3 is a functional block diagram showing internal configurations of a receiver and the fire sensor in FIG. 1.

FIG. 3 is a functional block diagram showing internal configurations of the receiver 100 and the multi-sensor type fire sensor 102 in the fire monitoring system of the present invention shown in FIGS. 1 and 2.

In FIG. 3, the receiver 100 comprises a transmitting portion 105, a CPU 106, an operating portion 108, and a display portion 110. Functions of a mode switching indicating portion 112 and a fire judging portion 114 are provided to the CPU 106. The mode switching indicating portion 112 transmits the mode switching instruction for selecting type of the response data to the multi-sensor type sensor 102 and then executes the mode switching.

The fire judging portion 114 receives response data from the multi-sensor type sensor 102 by transmitting the data request instruction (polling instruction) and then judges generation of the fire. of course, according to the fire judgment by the fire judging portion 114, fire judgment process is carried out based on the polling in the normal state and the interruption issued from the multi-sensor type sensor 102 in the fire.

The multi-sensor type sensor 102 comprises a smoke detector 30 as a smoke sensor, a heat detector 28 as a heat sensor, the transmitting portion 32, and the CPU 36. Functions of a multi-sensor processor 116, a smoke sensor processor 118, a heat sensor processor 120, a mode switching portion 122, and an interruption processor 124 are provided to the CPU 36.

The multi-sensor processor 116 can correct the smoke signal supplied from the smoke detector 30 based on the temperature signal supplied from the heat detector 28, then convert corrected smoke signal into corrected smoke data which is sent to the receiver 100, and then hold it. The smoke sensor processor 118 can convert the smoke signal supplied from the smoke detector 30 into smoke data which is sent to the receiver 100 and then hold it. Further, the heat sensor processor 120 can convert the temperature signal supplied from the heat detector 28 into temperature data which is sent to the receiver 100 and then hold it.

The mode switching portion 122 has a function for switching the smoke sensor mode to send the smoke data, the heat sensor mode to send the temperature data, and the multi-sensor mode to send the corrected smoke data. The mode switching portion 122 is switched into any one of the smoke sensor mode, the heat sensor mode, and the multi-sensor mode based on the mode switching instruction from the receiver 100. In this case, at the time of power-on when the power is supplied from the receiver 100 to the multi-sensor type sensor 102, the mode switching portion 122 is initialized into the multi-sensor mode.

The interruption processor 124 receives judging signals issued when corrected smoke data, smoke data, temperature data exceed predetermined threshold values decided as pre-alarm levels in the multi-sensor processor 116, the smoke sensor processor 118, and the heat sensor processor 120 respectively, and transmits an interruption signal to the receiver 100.

The fire judging portion 114 in the receiver 100, when receives the interruption signal from the interruption processor 124, transmits a n interruption retrieval instruction to retrieve the multi-sensor type sensor 102 which has transmitted the interruption signal, and then rendering the retrieved multi-sensor type sensor 102 to send the detection data continuously by transmit ting repeatedly a data request instruction to the retrieved sensor 102.

Figure 4:
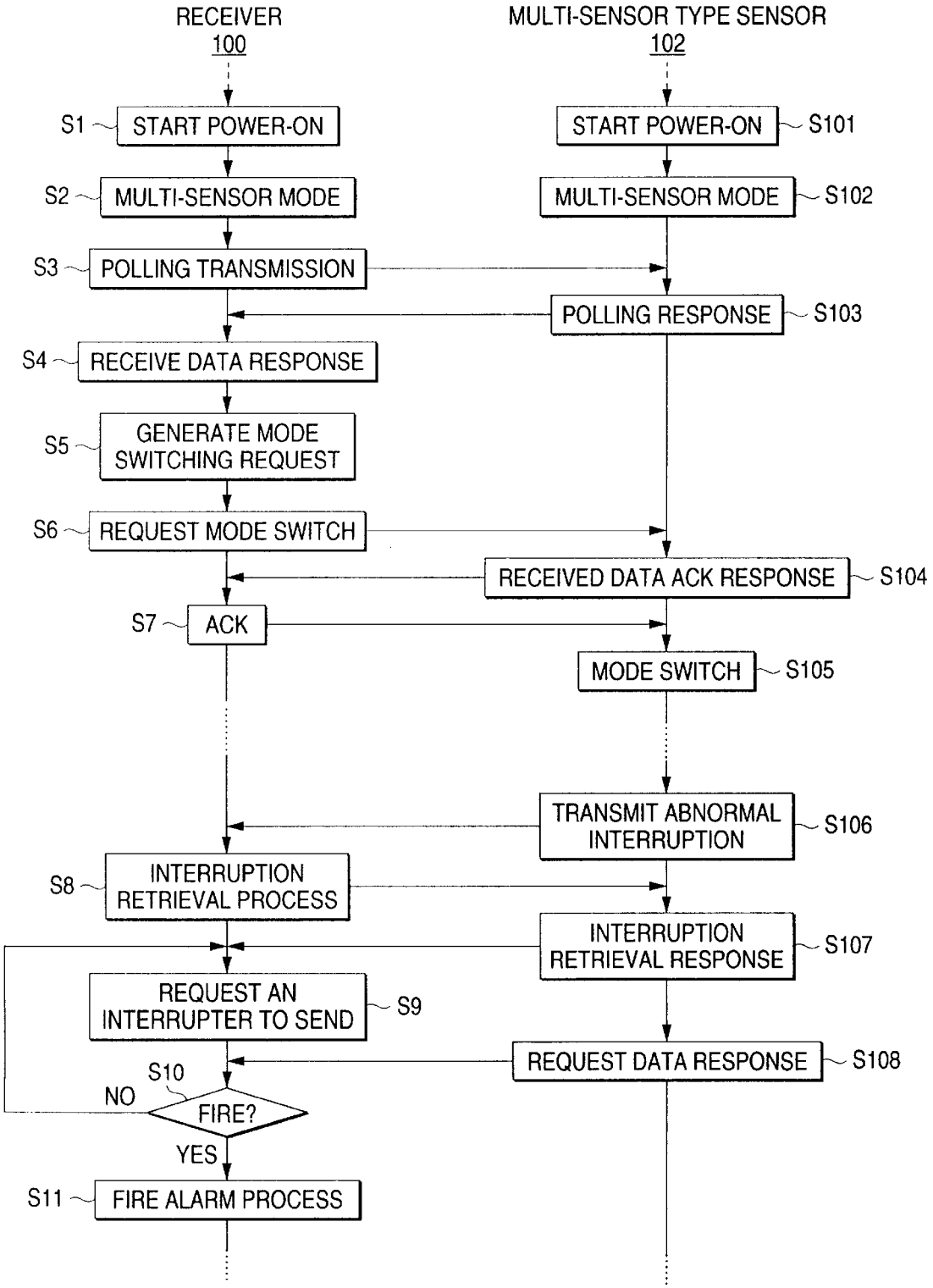
FIG. 4 is a time chart showing a mode switching operation and a polling operation between the receiver and the fire sensor in FIG. 3.

FIG. 4 is a schematic time chart showing a mode switching operation and a polling operation between the receiver 100 and the multi-sensor type sensor 102 in FIG. 3.

In FIG. 4, when power-on of the receiver 100 is started by turning on the power supply in step S1, power-on of the multi-sensor type sensor 102 is also started by receiving the power via the transmission line 101 in step S101. In this case, the receiver 100 and the multi-sensor type sensor 102 are initialized into a multi-sensor mode respectively in steps S2, S102.

Then, the receiver 100 executes polling transmission to designate the address of the sensor 102 in step S3. When receives this polling, the multi-sensor type sensor 102 then transmits the data detected in a mode at that time, i.e., a multi-sensor mode as polling response in step S103 if its own address coincides with a calling address. The receiver 100 then receives data response and saves it in the memory in step S4.

In such normal monitoring state, when the receiver 100 generates a mode switching request in step S5, it transmits an instruction for a mode switch request to the multi-sensor type sensor 102 based on the addressing of the sensor 102 in step S6.

When receives this instruction for the mode switch request, the multi-sensor type sensor 102 then transmits received data ACK response to the receiver 100 in step S104. The receiver 100 then compares mode switching control data, which is transmitted by the mode switch request in step S6, with reception control data, which is received as the ACK response from the sensor side. If they coincide with each other, the receiver 100 transmits an ACK command to the multi-sensor type sensor 102 in step S7. Then, mode switch of the sensor 102 is carried out in step S105.

In contrast, in the normal monitoring state, if the detection data exceeds a predetermined threshold value in the current switching mode, for example, in the multi-sensor type sensor 102, abnormal interruption is transmitted to the receiver 100 in step S106. The receiver 100, when receives this abnormal interruption, then issues an instruction for interruption retrieval process in step S8. The multi-sensor type sensor 102 then transmits interruption retrieval response in step S107 because its own sensor has transmitted the interruption.

Then, when receives such interruption retrieval response, the receiver 100 identifies the sensor 102 as the interrupter and then requests the interrupter to send the data in step S9. The multi-sensor type sensor 102 then sends request data response in step S108. Then, it is decided in step S10 whether or not the fire is caused. These processes insteps S9, S108, S10 are repeated until receiver 100 detects the fire in step 10. If the fire is detected in step S10, fire alarm process is carried out in step S11.

Figure 5:
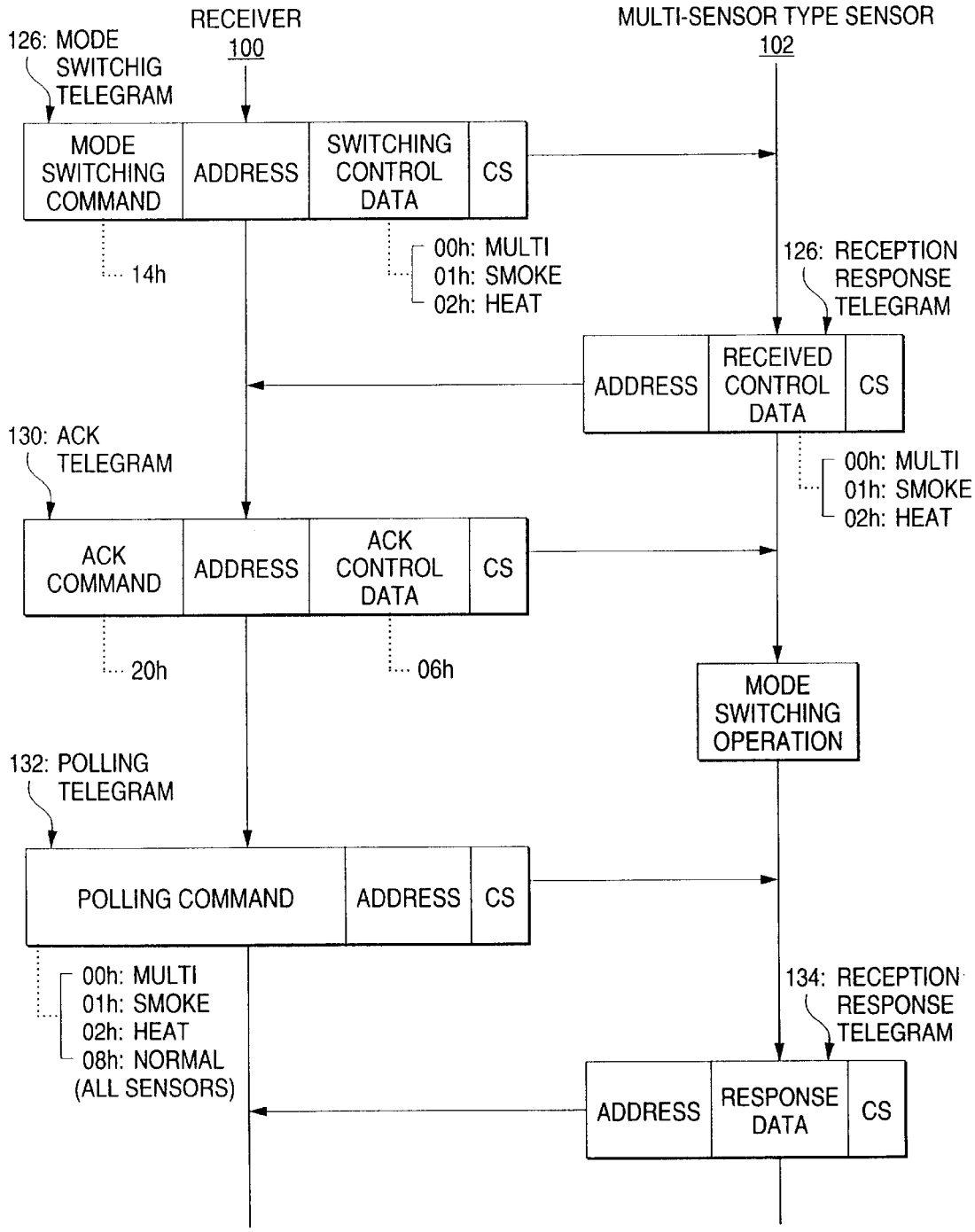
FIG. 5 is a view showing telegram formats of the mode switching operation and the polling operation in FIG. 4.

FIG. 5 shows the mode switching operation and the polling operation in FIG. 4 by using telegram transmission/reception in compliance with command formats between the receiver 100 and the multi-sensor type sensor 102 respectively.

First, mode switching instruction issued from the receiver 100 is carried out by transmitting a mode switching telegram 126 to the multi-sensor type sensor 102. This mode switching telegram 126 has a command format including mode switching command, address, switching control data, and Cs (check sum). As a command code of the mode switching command, "14h" is employed in a hexadecimal notation for example.

The switching control data "00h" instructs switching to the multi-sensor mode, the switching control data "01h" instructs switching to the smoke sensor mode, and the switching control data "02h" instructs switching to the heat sensor mode. When this mode switching telegram 126 is transmitted from the receiver 100, the multi-sensor type sensor 102 sends back a reception response telegram 128.

The reception response telegram 128 is composed of an address of the sensor, received control data, and CS. The received control data contains switching control data for the mode switching telegram 126. The switching control data "00h" corresponds to the multi sensor mode, the switching control data "01h" corresponds to the smoke sensor mode, and the switching control data "02h" corresponds to the heat sensor mode.

When the receiver 100 receives the reception response telegram 128 from the multi-sensor type sensor 102, it compares the switching control data with the received control data. If they coincide with each other, the receiver 100 transmits an ACK telegram 130 to the multi-sensor type sensor 102.

This ACK telegram 130 consists of ACK command using the command code "20h", address, ACK control data using the command code "06h", and CS. When receives the ACK telegram 130 from the receiver 100, the multi-sensor type sensor 102 executes a mode switching operation based on the switching control data which is receiving at that time.

In turn, a polling operation will be explained hereunder. During the polling, the receiver 100 transmits a polling telegram 132 to the multi-sensor type sensor 102. The polling telegram 132 is composed of polling command as the command code, address, and CS.

The multi-sensor mode is set by the command code "00h", the smoke sensor mode is set by the command code "01h", the heat sensor mode is set by the command code "02h", and the normal mode (all sensor mode) is set by the command code "08h". This command code instructs type of response data from the multi-sensor type sensor 102 in answer to the polling telegram 132.

However, the command code does not carry out the mode switching of the multi-sensor type sensor 102. In the normal polling operation, since the mode of the multi-sensor type sensor 102 is decided by the mode switching telegram 126, the polling for the normal mode is issued by the command code "08h".

In response to the polling telegram 132 having the command code "08h" for the normal mode, the multi-sensor type sensor 102 sends back the reception response telegram 134 which contains the response data corresponding to the mode at that time.

In contrast, any one of multi-sensor, smoke, and heat modes other than the normal mode specified by the command code "08h" in the polling telegram 132 is designated, the multi-sensor type sensor 102 sends data in the designated mode by the reception response telegram 134.

Accordingly, even in the normal polling, the receiver 100 can collect the data in the multi-sensor mode, the smoke mode, or the heat mode without the mode switching of the multi-sensor type sensor 102, by setting the mode which indicates type of necessary data as the polling command of the polling telegram 132 as the case may be. In addition, collection of requested type of data can be performed without the mode switching.

Figure 6:
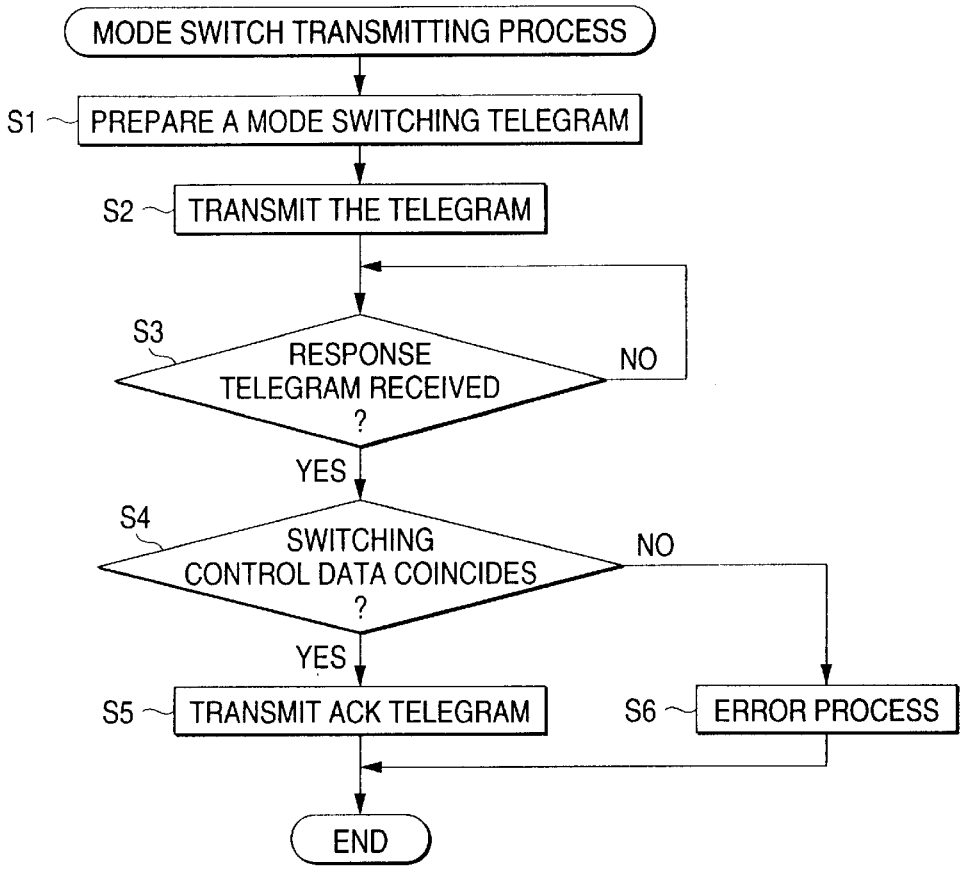
FIG. 6 is a flowchart showing a mode switch transmitting process effected by the receiver in FIG. 2.

FIG. 6 is a flowchart showing a mode switch transmitting process effected by the receiver 100 in the mode switching operation of FIG. 5. First, the mode switching telegram 126 in FIG. 5 is prepared in step S1. The mode switching telegram 126 is transmitted to the multi-sensor type sensor 102 in step S2.

Subsequently, it is checked in step S3 whether or not the reception response telegram 128 is received from the sensor side. Then, it is checked in step S4 whether or not the received switching control data coincides with the reception control data. If they coincides with each other, the receiver 100 transmits the ACK telegram 130 to confirm in step S5, and then the switching process is ended.

On the contrary, unless the switching control data coincides with the reception control data in the reception response telegram 128 in step S4, the receiver 100 executes the error process in step S6, and then the process is ended. In place of the error process in step S6, the mode switch transmitting process may be conducted once again from step S1. Unless the coincidence can be achieved after such process has been tried predetermined times, an error is issued at that time to perform the abnormal termination.

Figure 7:
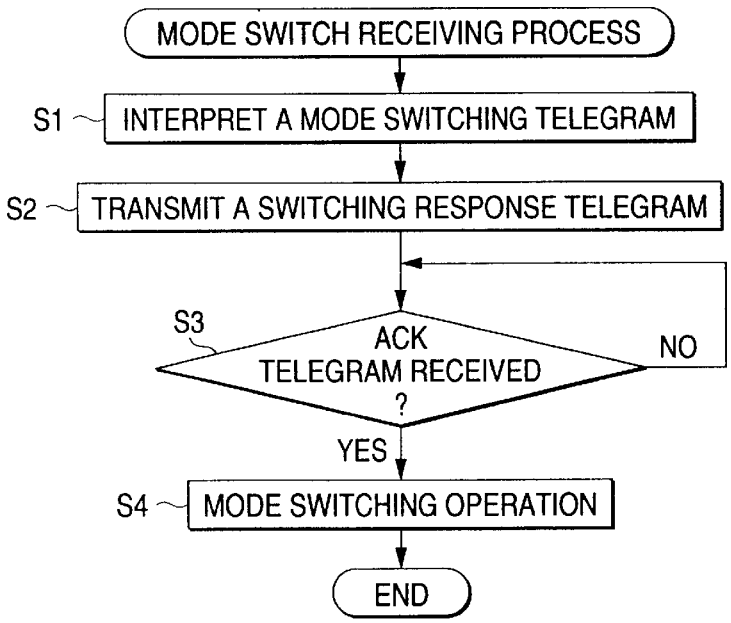
FIG. 7 is a flowchart showing a mode switch receiving process effected by the fire sensor in FIG. 2.

FIG. 7 is a flowchart showing a mode switch receiving process effected by the multi-sensor type sensor 102 in the mode switching operation in FIG. 5. In step S1, the multi-sensor type sensor 102 interprets the mode switching telegram received from the receiver 100 and then recognizes the switching mode being instructed by the switching control data.

Then, the switching response telegram 128 which contains the received switching control data in the reception control data is transmitted to the receiver 100 in step S2. Reception of the ACK telegram 130 from the receiver 100 is waited to confirm in step S3. Then, in step S4, a mode switching operation is carried out based on the switching control data in the mode switching telegram instructed in step S1.

Figure 8:
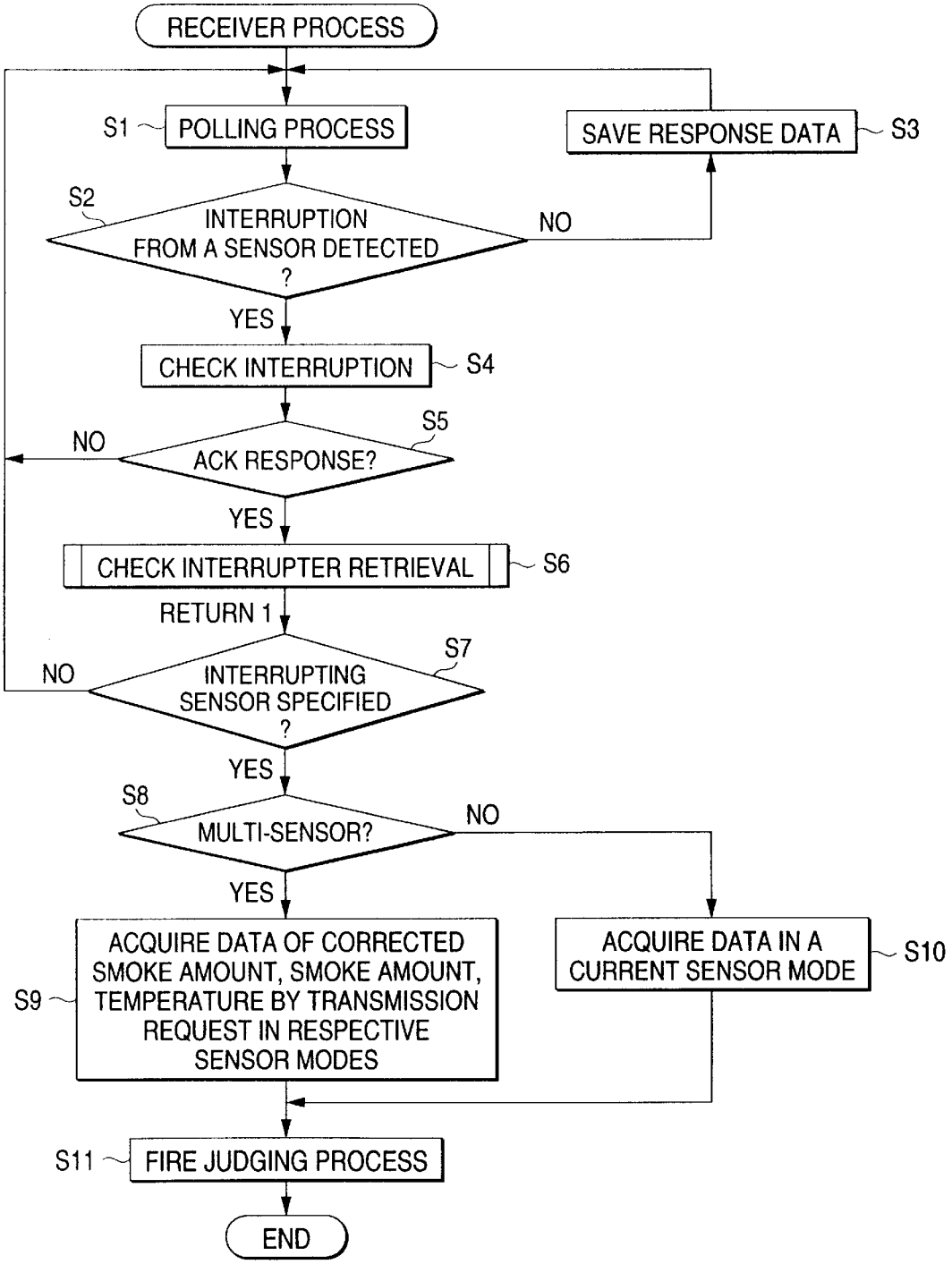
FIG. 8 is a flowchart showing a monitoring process of the receiver in FIG. 2.

FIG. 8 is an overall flowchart showing a monitoring process of the receiver 100 in FIG. 2. The receiver 100 executes the polling transmission in step S1. If the receiver 100 detects no interruption from the sensor 102 instep S2, it receives the response data and saves it in step S3. Since the interruption signal is transmitted from a particular sensor when the fire is caused, it is decided in step S2 whether or not the interruption is issued from the sensor. Then, the interruption is checked by the telegram using the interruption command code "46h" in step S4. If the ACK response is detected in step S5, then interrupter retrieval process is executed in step S6.

If the interrupting sensor can be specified based on the result of the retrieval process in step S7, the process goes to step S8 wherein the receiver 100 checks whether or not the interrupting sensor is the multi-sensor type sensor 102. If the interrupting sensor is the multi-sensor type sensor 102 in step S8, the process goes to step S9. Instep S9, the receiver 100 acquires sequentially the corrected smoke data, the smoke data, the temperature data from the multi-sensor type sensor 102 in response to the transmission request in three sensor modes.

More particularly, as the response control data in the polling telegram 132 in FIG. 5, the multi-sensor mode of "00h", the smoke sensor mode of "01h", and the heat sensor mode of "02h" in the polling telegram 132 are sequentially transmitted to acquire the data in respective modes.

In contrast, unless the interrupting sensor is the multi-sensor type sensor 102 in step S8, the process goes to step S10. In this step S10, the data in a current sensor mode on the sensor side is acquired via the transmission at the normal mode of "08h" as the polling command in the polling telegram 132 in FIG. 5. Then, in step S11, fire judging process is executed based on the data acquired on the sensor side in step S9 or step S10.

Figure 9:
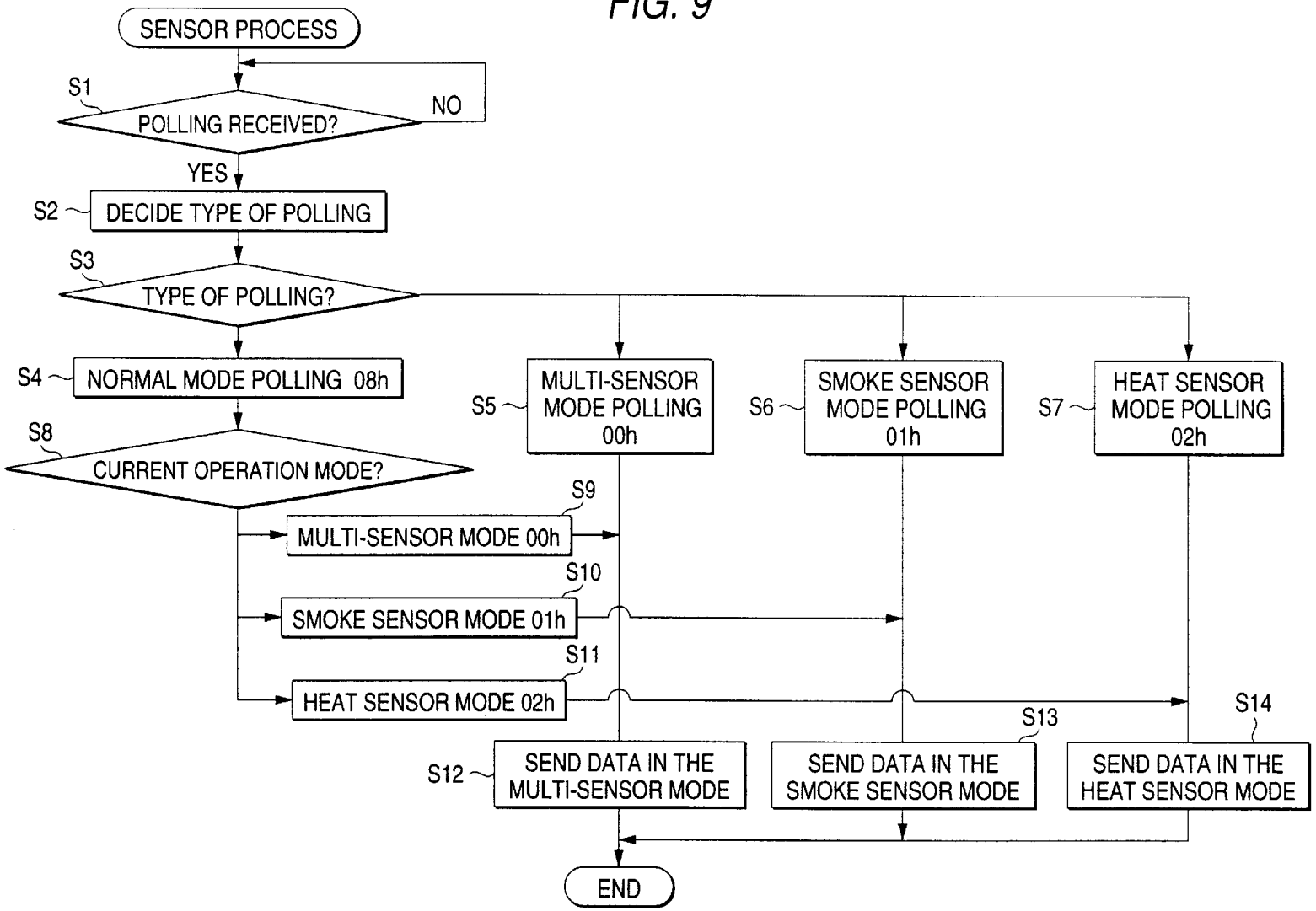
FIG. 9 is a flowchart showing an operation process of the fire sensor in FIG. 2.

FIG. 9 is a flowchart showing sensor process taken on the multi-sensor type sensor 102 side, which corresponds to the receiver process in FIG. 8. If it is decided in step S1 that the polling telegram is received, the process advances to step S2 where type of the polling is decided.

Then, in step S3, the type of the polling is decided selectively as the normal mode polling in step S4, the multi-sensor mode polling in step S5, the smoke sensor mode polling in step S6, and the heat sensor mode polling in step S7. If the type of the polling is decided as the normal mode polling in step S4, the process goes to step S8 wherein the current operation mode in the multi-sensor type sensor 102 is decided.

The current operation mode in the multi-sensor type sensor 102 is any one of the multi-sensor mode in step S9, the smoke sensor mode in step S10, and the heat sensor mode in step S11. Then, if the current operation mode is the multi-sensor mode in step S9, the process advances to step S12 where the multi-sensor type sensor 102 sends the data in the multi-sensor mode.

If the current operation mode is the smoke sensor mode in step S10, the multi-sensor type sensor 102 sends the data in the smoke sensor mode in step S13. Further, if the current operation mode is the heat sensor mode instep S11, the multi-sensor type sensor 102 sends the data in the heat sensor mode in step S14.

In contrast, if the type of the polling decided in step S3 is other than the normal mode polling in step S4, the data in respective sensor modes are sent in steps S12, S13, S14 respectively, according to decision results of the multi-sensor mode polling in step S5, the smoke sensor mode polling instep S6, and the heat sensor mode polling in step S7.

Figure 10:
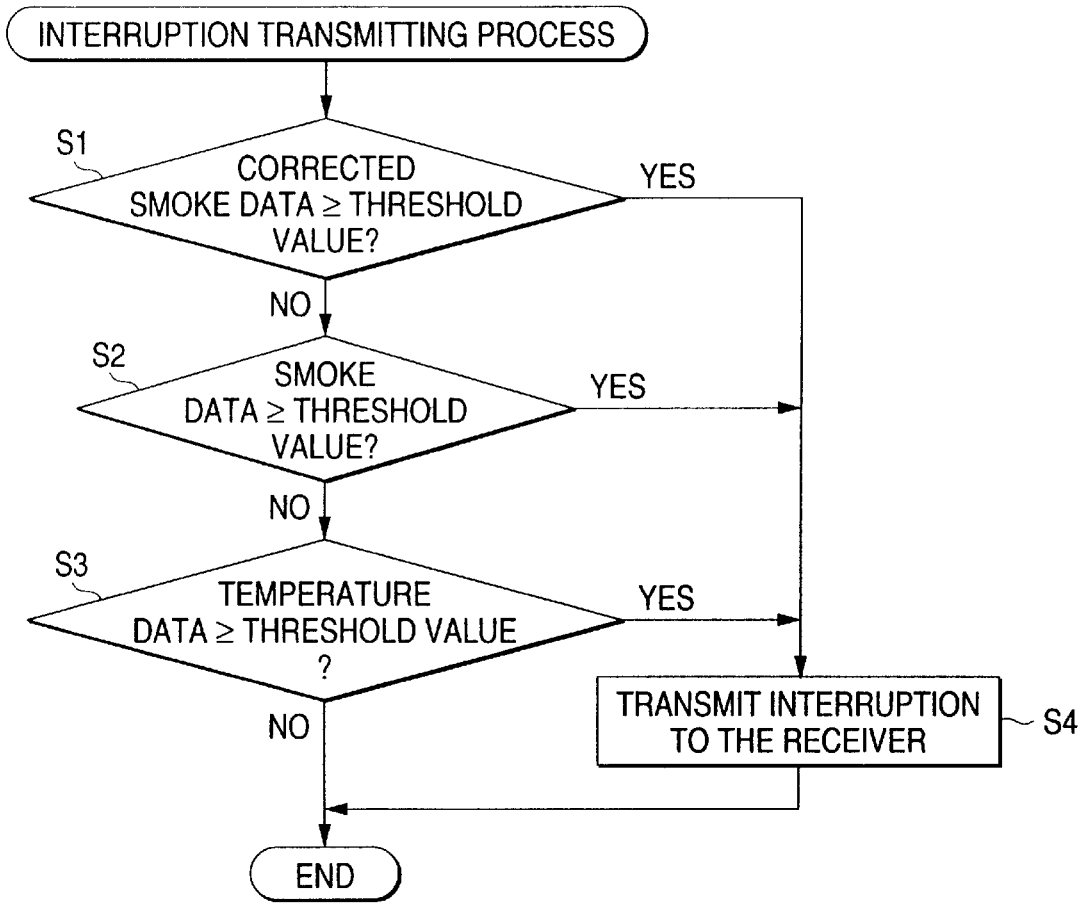
FIG. 10 is a flowchart showing an interruption transmitting process in the fire sensor in FIG. 2.

FIG. 10 is a flowchart showing an interruption transmitting process by the interruption processor 124 in the multi-sensor type sensor 102 in FIG. 2. In this interruption transmitting process, the corrected smoke data in the multi-sensor mode is compared with a predetermined threshold value (i.e., corrected smoke data≧threshold value) in step S1. The smoke data in the smoke sensor mode is compared with a predetermined threshold value (i.e., smoke data≧threshold value) in step S2. The temperature data in the heat sensor mode is compared with a predetermined threshold value (i.e., temperature data≧threshold value) in step S3.

The data in any mode in steps S1 to S3 exceeds the predetermined threshold value, the process proceeds to step S4 wherein the multi-sensor type sensor 102 transmits the interruption to the receiver 100.

Figure 11:
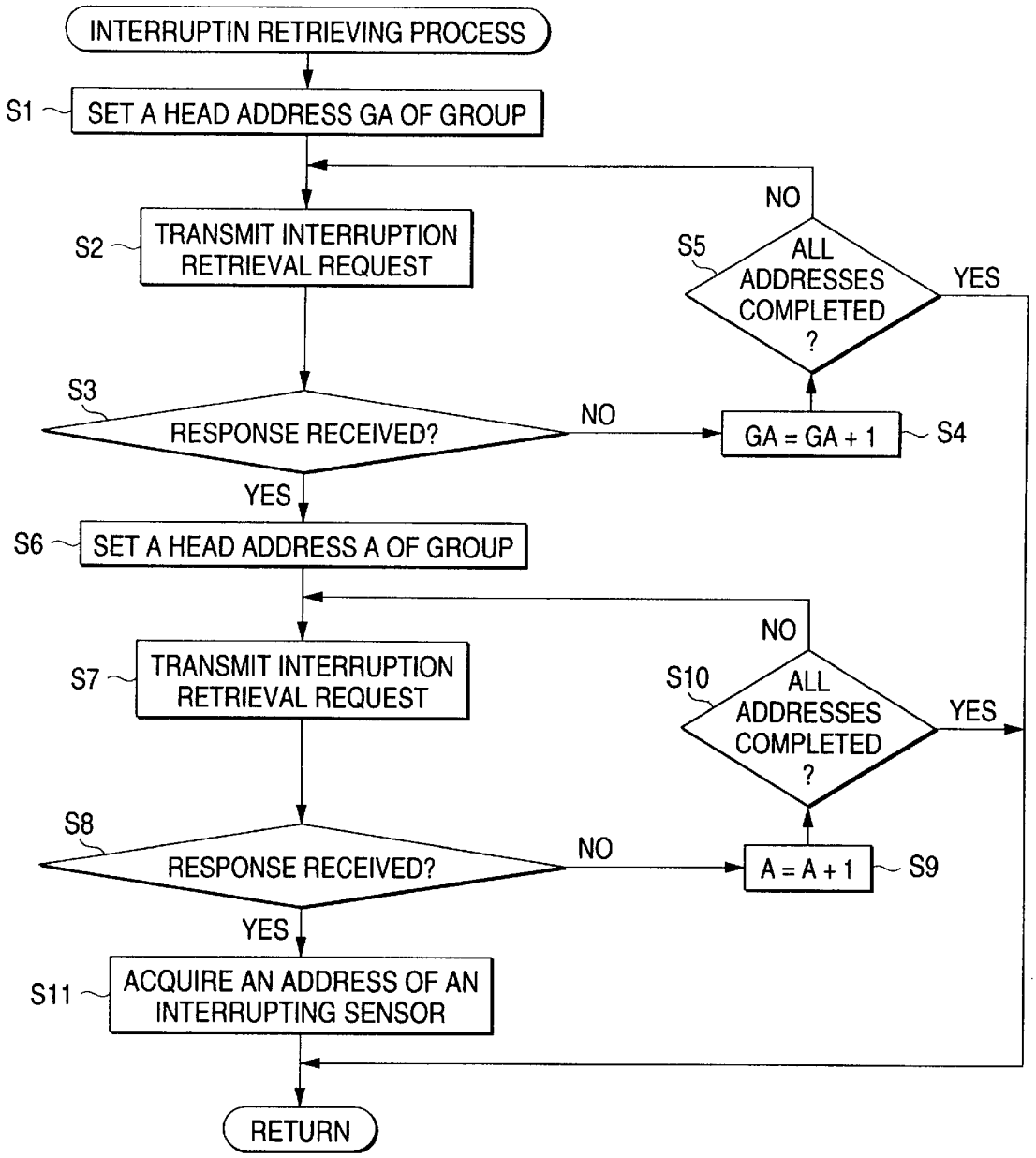
FIG. 11 is a detailed flowchart showing a retrieval process in the receiver in FIG. 2.

FIG. 11 is a detailed flowchart showing interruption retrieving process in step S6 of the flowchart for the receiver process in FIG. 8 when the receiver receives the interruption signal from the sensor side. In this interruption retrieving process, first a head address GA of the sensor group, which is previously selected, is set in step S1. As the group address, an upper address bit of the sensor address or a dedicated group address may be employed.

In turn, the command telegram of interruption retrieval request indicating the head group address is transmitted in step S2. In this case, for example, "41h" is allocated to the command code for group retrieval.

If the receiver 100 receives the response from the particular sensor belonging to the group in step S3, the process goes to the retrieval process in step S6, in which the head address A in the group is set. If the receiver 100 receives no response from the particular sensor in step S3, the group address GA is incremented by one in step S4. The interruption retrieval request is transmitted repeatedly in step S2 until the final address can be detected in step S5.

If retrieval of the group address is ended and then the head address A in the group is set in step S6, the command telegram of the interruption retrieval request is transmitted according to the designation by the head address in the group, e.g., the sensor address of the group in step S7. Then, it is checked in step S8 whether or not the response is transmitted. In this case, for example, "44h" is allocated to the command code for the address retrieval. This response data is an analog value in the current set mode.

If the response is transmitted in step S8, the receiver 100 recognizes the sensor which has issued the response as the interrupter and then acquires an address of an interrupting sensor in step S11. Unless the response is transmitted in step S8, the address A in the group is incremented by one in step S9. Then, the process in steps S7, S8 are repeated until all addresses have been completed in step S10.

Figure 12:
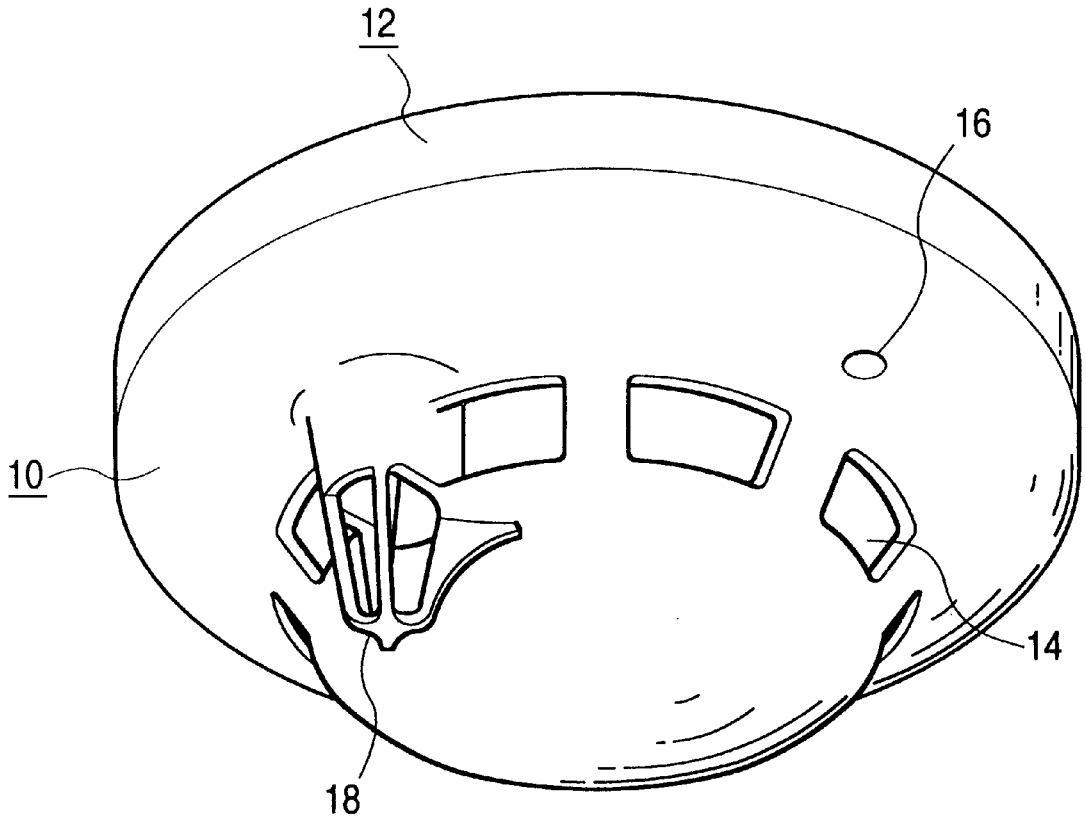
FIG. 12 is a view showing an outer appearance of a fire sensor according to the present invention.

FIG. 12 is a view showing a situation that a fire sensor according to the present invention is fitted onto a ceiling, etc. The fire sensor according to the present invention comprises a head 10 and a base 12. The base 12 is secured to the ceiling, and the head 10 is attached to the base 12 from the lower side. The head 10 can be detachably attached to the base 12.

A plurality of smoke flow inlets 14 are opened around a detection portion which is projected from a center portion of the head 10. A sensor cover 18 formed like a cage (basket) is provided to protrude downward from the head 10. A temperature detecting element which employs a thermistor for detecting an external temperature is fitted in the sensor cover 18. Also, a working indicator 16 employing an LED is installed on the head 10.

Figure 13A:
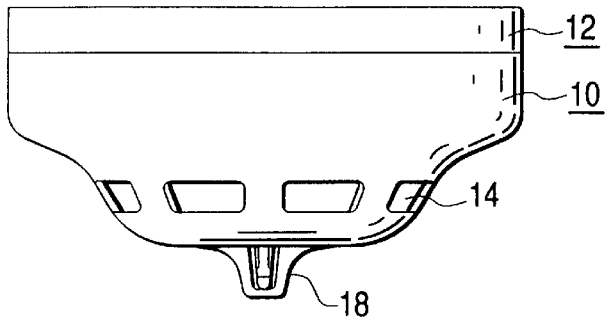
FIG. 13A is a front side view of the fire sensor shown in FIG. 12.
Figure 13B:
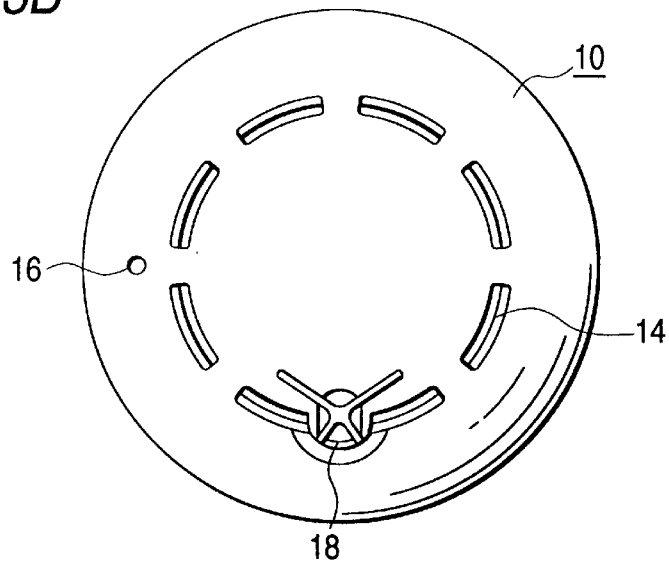
FIG. 13B is a bottom side view of the fire sensor shown in FIG. 12.
Figure 13C:
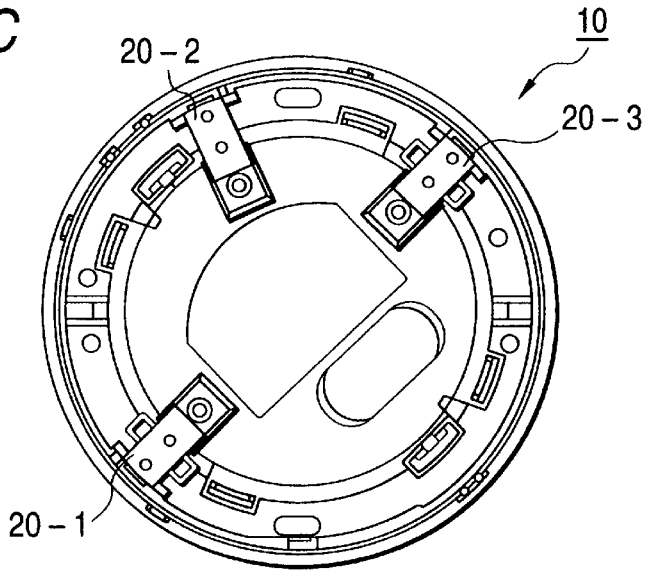
FIG. 13C is a top side view of the fire sensor shown in FIG. 12.

FIG. 13A is a front view showing the fire sensor according to the present invention shown in FIG. 12. FIG. 13B is a bottom view showing the fire sensor viewed from the bottom side of the head 10 in FIG. 12. FIG. 13C is a plan view showing the fire sensor viewed from the top side of the head 10.

As evident from FIG. 13A, the sensor cover 18 provided to the lower side of the head 10 is protruded downward longer than the center projected portion around which the smoke flow inlets 14 are formed. Thus, the temperature detecting element such as the thermistor which is built in the sensor cover 18 can detect sufficiently effectively a hot air flow caused in the fire.

The smoke which spreads out along with the hot air flow caused in the fire can enter into the fire sensor via the smoke flow inlets 14 which are opened on the periphery of the fire sensor, so that the smoke can be detected by a built-in smoke sensor mechanism. In this case, as shown in FIG. 13B, since the smoke flow inlets 14 are formed over an entire periphery of the head 18 at a constant distance, the smoke can flow into the inside of the fire sensor from all directions and thus the smoke can be detected.

In addition, as shown in FIG. 13C, three fitting terminal jigs 20-1, 20-2, 20-3, for example, are mounted on the top of the head 10. Fitting receiver jigs are mounted on the bottom surface of the base 12 of the fire sensor so as to correspond to the fitting terminal jigs 20-1, 20-2, 20-3. The fitting terminal jigs 20-1, 20-2, 20-3 can be fitted into the fitting receiver jigs on the base 12 side by pushing the head 10 against the base 12 upward and then turning the head 10. As a result, the head 10 can be connected electrically and mechanically to the base 12.

Figure 14:
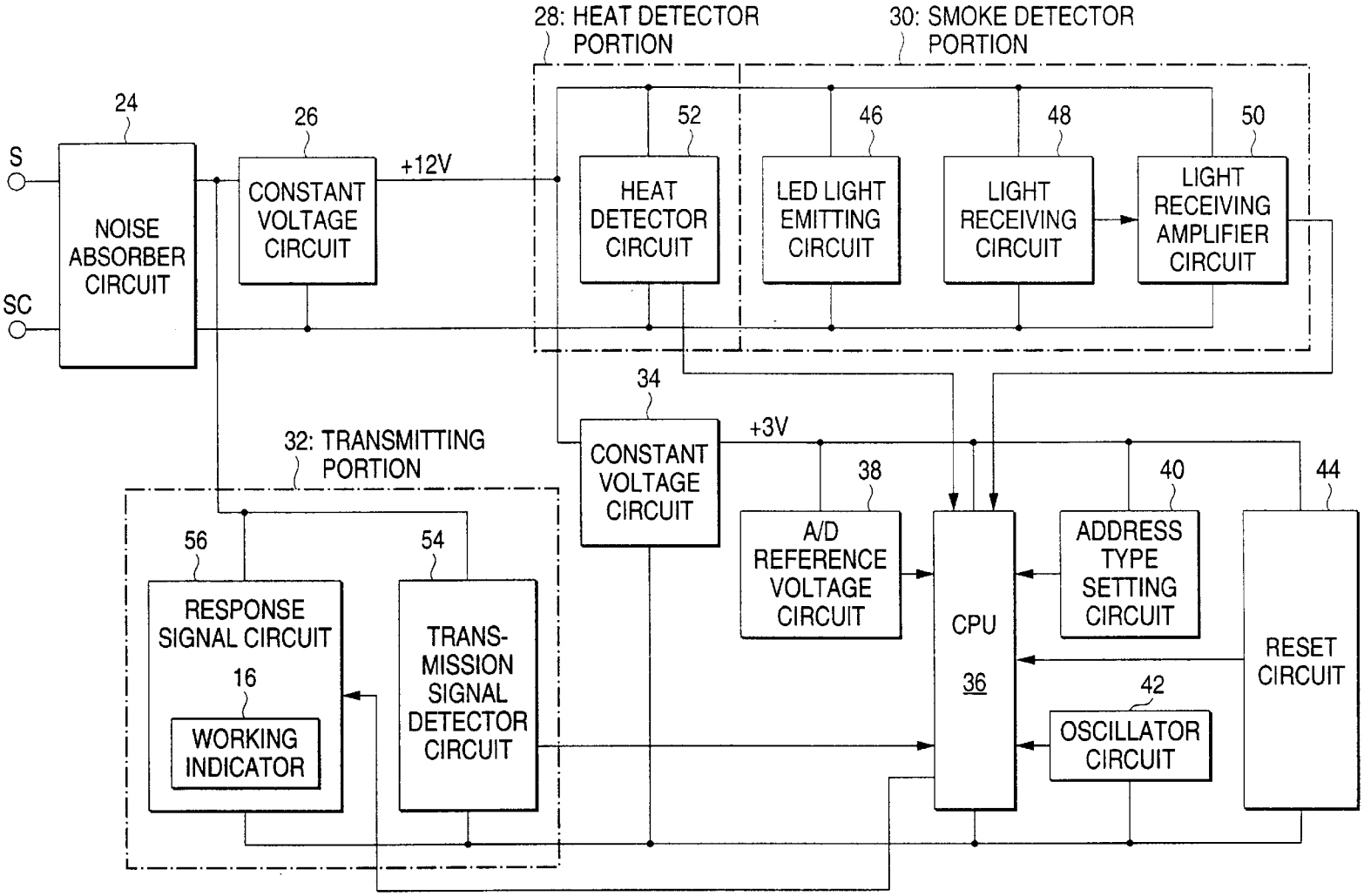
FIG. 14 is a block circuit diagram showing the fire sensor shown in FIG. 12.

FIG. 14 is a block circuit diagram showing internal circuits of the fire sensor according to the present invention. In FIG. 14, following to terminals S, SC which are connected to the receiver side, a noise absorber circuit 24 and a constant voltage circuit 26 are provided in sequence. The constant voltage circuit 26 can stabilize a power supply voltage supplied from the receiver side into +12 V, for example, and then output a stabilized voltage. A heat detector portion 28 and a smoke detector portion 30 are provided at the succeeding stage of the constant voltage circuit 26.

A transmitting portion 32 is provided at the preceding stage of the constant voltage circuit 26. A constant voltage circuit 34 is provided subsequently to the transmitting portion 32. The constant voltage circuit 34 receives a power supply voltage of +12 V from the constant voltage circuit 26 and then generates a stabilized constant voltage output of +3 V. A CPU 36 is provided after the constant voltage circuit 34. An A/D reference voltage circuit 38, an address type setting circuit 40, an oscillator circuit 42, and a reset circuit 44 are connected to the CPU 36.

A heat detector circuit 52 is provided in the heat detector portion 28. As shown in a block circuit diagram of FIG. 15, the heat detector circuit 52 includes an external thermistor 58, an external temperature detector circuit 60, an internal thermistor 62, and an internal temperature detector circuit 64. The external thermistor 58 is positioned in the sensor cover 18 provided onto the head 10 in FIG. 12 in the condition that it can be exposed to an outer air. Thus, the external thermistor 58 can generate change in its resistance value in response to an external temperature.

The external temperature detector circuit 60 can convert change in the resistance value of the external thermistor 58 into an external temperature signal which corresponds to an external temperature To, and then output the external temperature signal to the CPU 36. The internal thermistor 62 is positioned in the inside of the head 10 in FIG. 12 not to be exposed to the outer air. Thus, the internal thermistor 62 can generate change in its resistance value in response to an internal temperature Ti. According to the change in the resistance value of the internal thermistor 62, the internal temperature detector circuit 64 can output an internal temperature signal, which corresponds to the internal temperature Ti, to the CPU 36 in FIG. 14.

Referring to FIG. 14 once again, the smoke detector portion 30 comprises an LED light emitting circuit 46, a light receiving circuit 48, and a light receiving amplifier circuit 50. The LED light emitting circuit 46 can operate to generate a light from an LED as a light source intermittently. In order to generate the light, the LED may be driven in synchronism with a calling signal, which is supplied during a constant period from the receiver to the terminals S, SC, otherwise the LED may be driven by a frequency-divided pulse, which is divided from a clock pulse from the oscillator circuit 42, at a constant time interval.

The light receiving circuit 48 can receive a scattered light and then convert it into an electric signal. Such scattered light is generated when the light emitted from the LED being driven by the LED light emitting circuit 46 is scattered by the smoke flowing into the sensor in the fire. A weak light signal received by the light receiving circuit 48 is amplified by the light receiving amplifier circuit 50, and then output to the CPU 36 as a smoke signal.

The transmitting portion 32 comprises a transmission signal detector circuit 54 and a response signal circuit 56. A working indicator 16 is included in the response signal circuit 56. The transmission signal detector circuit 54 can receive a request-to-send signal supplied to the terminals S, SC from the receiver (not shown), and then transmit the request-to-send signal to the CPU 36. This request-to-send signal from the receiver is formatted by a command, an address, and a check sum.

When the CPU 36 receives the request-to-send signal from the receiver via the transmission signal detector circuit 54, such CPU 36 can correct the smoke signal S, which is input from the light receiving amplifier circuit 50, by using a correction factor K based on the external temperature To from the heat detector circuit 52 and temperature difference $\Delta T(=To-Ti)$ between the external temperature To and the internal temperature Ti, and then output the corrected smoke data S to the receiver side via the response signal circuit 56.

The working indicator 16 is driven by the response signal circuit 56 to be turned on when the CPU 36 executes a reply operation for the receiver. Also, the working indicator 16 may be turned on according to the fire detecting signal supplied from the receiver when the fire is detected based on the smoke data S being transmitted to the receiver. In other words, the working indicator 16 is flashed at the time of transmission of the response signal, and the working indicator 16 is turned on when the fire sensor receives the fire detecting signal from the receiver.

The request-to-send signal for the fire sensor from receiver is transmitted as change in the voltage over a pair of signal lines being connected to the terminals S, SC. On the other hand, the response signal from the transmitting portion 32 of the fire sensor is transmitted as a current mode in which a current is flown between the signal lines.

The A/D reference voltage circuit 38 can output reference voltages for A/D converters 66, 68, 70 which are provided in the CPU 36. The A/D converters 66, 68, 70 can convert the external temperature To signal and the internal temperature Ti signal, both are supplied from the heat detector circuit 52, and the smoke signal S, which is supplied from the light receiving amplifier circuit 50, into digital signals respectively.

The address type setting circuit 40 can set sensor addresses in the CPU 36 and also decides types of the sensor.

The oscillator circuit 42 can oscillate a clock pulse to operate the CPU 36. When the power supply voltage which is supplied from the constant voltage circuit 34 to the CPU 36 rises up to a specified voltage in turning on the power supply on the receiver side, the reset circuit 44 can perform initial reset of the CPU 36 by outputting a reset signal to the CPU 36.

Figure 16:
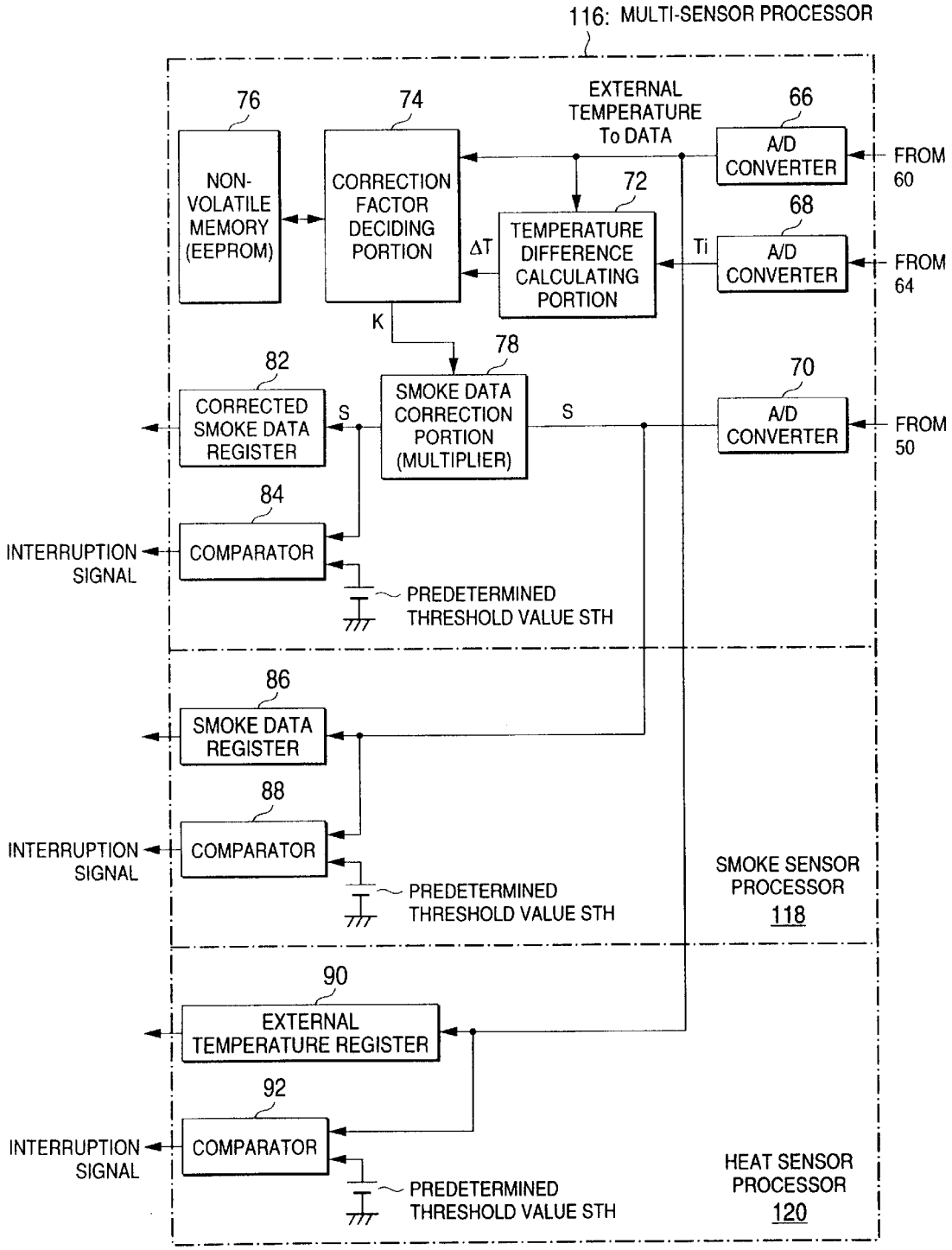
FIG. 16 is a functional block diagram showing a multi-sensor processor, a fire sensor processor, and a heat sensor processor according to a first embodiment of the present invention which can be implemented by using a CPU shown in FIG. 14.

FIG. 16 is a functional block diagram showing a multi-sensor processor, a smoke sensor processor, and a heat sensor processor in FIG. 3 according to a first embodiment of the present invention. In FIG. 16, the multi-sensor processor 116 includes A/D converters 66, 68, 70, a temperature difference calculator portion 72, a correction factor deciding portion 74, a nonvolatile memory 76 such as EEPROM, etc., a smoke data correction portion 78 using a multiplier, a corrected smoke data register 82, and a comparator 84.

Figure 15:
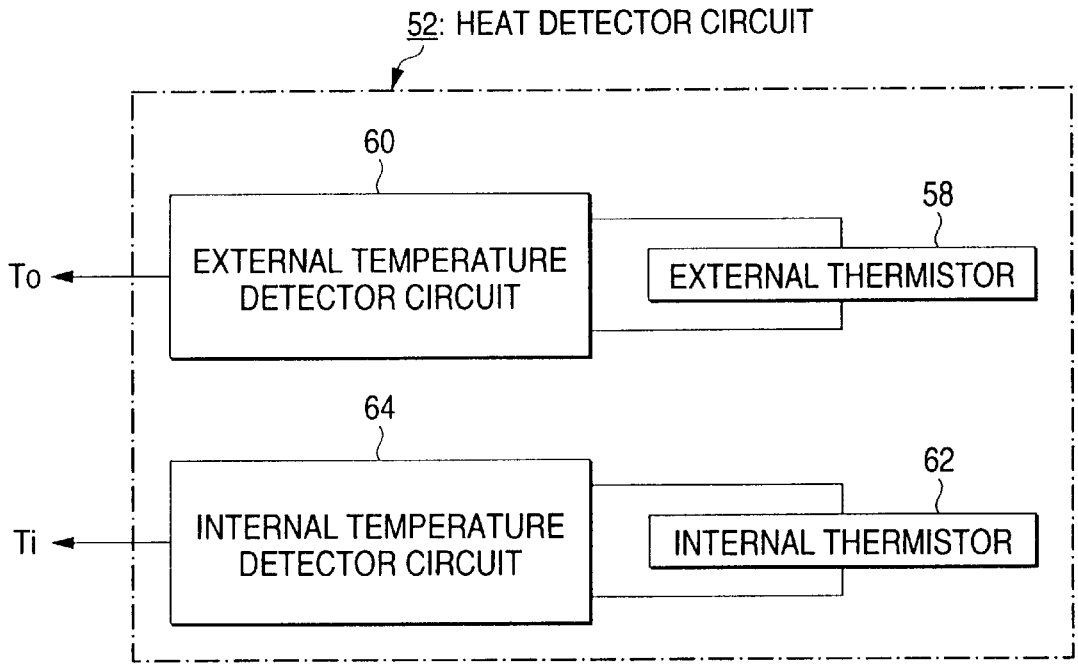
FIG. 15 is a block circuit diagram showing a heat detector circuit shown in FIG. 14 and having an external thermistor and an internal thermistor.

The A/D converter 66 can convert the external temperature To signal, which is supplied from the external temperature detector circuit 60 provided in the heat detector circuit 52 in FIG. 15, into a digital external temperature To data and then fetches the data. The A/D converter 68 can A/D-convert the internal temperature Ti signal, which is supplied from the internal temperature detector circuit 64 provided in the heat detector circuit 52 in FIG. 15, into an internal temperature Ti data and then fetches the data. In addition, the A/D converter 70 can convert the smoke signal, which is supplied from the light receiving amplifier circuit 50 provided in the smoke detector portion 30 in FIG. 14, into a digital smoke data S and then fetches the data.

The temperature difference calculator portion 72 can calculate a difference between the external temperature To data fetched by the A/D converter 66 and the internal temperature Ti data fetched by the A/D converter 68 as temperature difference ΔT, and then output the difference to the correction factor deciding portion 74. This temperature difference ΔT represents a rate of temperature rise when the fire sensor receives the hot air flow by the fire.

Based on both the external temperature To data and the temperature difference ΔT, the correction factor deciding portion 74 can decide the correction factor K which is employed to correct the smoke data S fetched by the A/D converter 70.

This correction factor K can be saved in advance in the nonvolatile memory 76 based on two temperature conditions of the external temperature To data and the temperature difference ΔT. An address of the nonvolatile memory 76 in which the corresponding correction factor K based on the external temperature To data derived at that time and the temperature difference ΔT is stored is detected. Then, the concerned correction factor K is read out according to the designation of the nonvolatile memory 76 by the address, and then is output to the smoke data correction portion 78.

The smoke data correction portion 78 can output smoke data S corrected by multiplying the smoke data S, which are fetched by the A/D converter 70, by the correction factor K which is output from the correction factor deciding portion 74. In other words, the smoke data correction portion 78 carries out the correction $$S=K\times S$$

and then outputs such smoke data S.

The comparator 84 compares the corrected smoke data S supplied from the smoke data correction portion 78 with a predetermined threshold value Sth, and then outputs a comparison output as an interruption signal when the corrected smoke data S exceeds the threshold value Sth.

The smoke sensor processor 118 consists of a smoke data register 86 and a comparator portion 88. The smoke data register 86 holds the smoke data S fetched by the A/D converter 70. The comparator portion 88 compares the smoke data S fetched by the A/D converter 70 with a predetermined threshold value Sth, and then outputs a comparison output as an interruption signal when the smoke data S exceeds the threshold value Sth.

The heat sensor processor 120 consists of an external temperature data register 90 and a comparator portion 92. The external temperature data register 90 holds the external temperature To data fetched by the A/D converter 66. The comparator portion 92 compares the external temperature To data fetched by the A/D converter 66 with a predetermined threshold value Tth, and then outputs a comparison output as an interruption signal when the external temperature To data exceeds the threshold value Tth.

FIGS. 17A and 17B show correction factors K for the smoke data as table information, based on the external temperature To data and the temperature difference ΔT in the present invention. Such table information can be accomplished by the correction factor deciding portion 74 and the nonvolatile memory 76 in FIG. 16.

In FIG. 17A, the column of the table shows the external temperature To (° C.). In this embodiment, the column of the table is divided into six temperature ranges, i.e., below 40.0° C., 40.0° C.≦To<50.0° C., 50.0° C.≦To<60.0° C., 60.0° C.≦To<70.0° C., 70.0° C.≦To<80.0° C., and over 80.0° C.

The row of the table shows the temperature difference ΔT (° C.). The row of the table is divided into four temperature ranges, i.e., below 5.5° C., 5.5° C.≦ΔT<13.0° C., 13.0° C.≦ΔT<20.5° C., and over 20.5° C. In respective cells of the table which are partitioned by six temperature ranges of the external temperature To and four temperature ranges of the temperature difference ΔT, numerical values of the correction factor K for the smoke data S are set previously, as shown in FIG. 6A.

The correction factor K has values ranging from 1.0 to 1.6 at maximum, for example. Where the correction factor K=1.0 means that no correction is effected. Accordingly, assume that the correction factor K=1.0 means no correction, the table shown in FIG. 17A can be given as a table shown in FIG. 17B. Based on information in the table shown in FIG. 17B, the correction factor K is decided in the present embodiment as follows.

If the external temperature To is below 40.0° C., the correction is not carried out at all, no matter which cell the temperature difference ΔT belongs to. Also, if the temperature difference ΔT is below 5.5° C., the correction is not carried out at all, no matter which temperature range the external temperature To belongs to. In other words, in the ranges in which no correction is carried out, the fire sensor of the present invention operates as a smoke detector which does not correct the smoke data S and then outputs them as they are.

In contrast, in respective ranges wherein the external temperature To is over 40.0° C. and the temperature difference ΔT is over 5.5° C., the correction factor K which corrects the smoke data so as to increase the smoke detection sensitivity is set. More particularly, in the range of the external temperature To of 40.0° C.≦To<50.0° C., the correction factor K=1.1 if the range of the temperature difference ΔT is 5.5° C.≦ΔT<13.0° C., the correction factor K=1.2 if the range of the temperature difference ΔT is 13.0° C.≦ΔT<20.5° C., and the correction factor K=1.3 if the range of the temperature difference ΔT is over 20.5° C.

Then, in the range of the external temperature To of 50.0° C.≦To<60.0° C., the correction factor K is set to 1.2, 1.3, and 1.4 respectively when the temperature difference ΔT is 5.5° C≦ΔT<13.0° C., 13.0° C.≦ΔT<20.5° C., and over 20.5° C. Values of the correction factor K are incremented rather than the case where the preceding external temperature To is 40.0° C.≦To<50.0° C.

Then, in the range of the external temperature To of 60.0° C.≦To<70.0° C., the correction factor K is set to 1.3, 1.4, and 1.5 respectively when the temperature difference ΔT is 5.5° C.≦ΔT<13.0° C., 13.0° C.≦ΔT<20.5° C., and over 20.5° C. The higher values of the correction factor K than those assigned to the preceding external temperature To are set.

Then, in the range of the external temperature To of 70.0° C.≦To<80.0° C., no correction is made since the correction factor K is set to 1.0 when the temperature difference ΔT is 5.5° C.≦ΔT<13.0° C. Similarly, the correction factor K is set to 1.4 and 1.5 respectively when the temperature difference ΔT is 13.0° C.≦ΔT<20.5° C., and over 20.5° C. Then, in the range of the external temperature To of over 80.0° C., no correction is also made since the correction factor K is set to 1.0 when the temperature difference ΔT is 5.5° C.≦ΔT<13.0° C. Similarly, the correction factor K is set to 1.5 and 1.6 respectively when the temperature difference ΔT is 13.0° C.≦ΔT<20.5° C., and over 20.5° C.

The reason for that no correction is made when the external temperature To is 70.0° C.≦To<80.0° C. and over 80.0° C. respectively and the temperature difference ΔT is 5.5° C.≦ΔT<13.0° C. can be given as follows. That is, the condition in which the external temperature To is high like 70.0° C. or more but the temperature difference ΔT is relatively small like 5.5° C.≦ΔT<13.0° C. corresponds to the temperature circumstance which is caused by heat sources other than the fire. In such case, the correction of the smoke data S is not made.

This condition corresponds to the case where, for example, the fire sensor directly receives the heat radiation or the hot air flow from the space heater. Thus, the external temperature To is high like 70.0° C. or more but the rate of temperature rise is not so increased high unlike the fire. As a result, in order to prevent the non-fire alarm which is generated by correcting the smoke data to increase the smoke detection sensitivity, no correction is made.

More particularly, decision of the correction factors K which are specified by two parameters, i.e., the external temperature To and the temperature difference ΔT, shown in FIG. 17B can be achieved by using an address table and stored data in the nonvolatile memory shown in FIG. 18. FIG. 18A is the address table of the nonvolatile memory 76 in FIG. 18B.

In the address table shown in FIG. 18A, addresses of the nonvolatile memory 76 given in FIG. 18B are stored in the cells, which are specified by the same temperature ranges as the external temperature To and the temperature difference ΔT shown in FIG. 17B, except for the no correction cells. For example, addresses 28, 29, 30; 31, . . . ; 39, 40 are stored in sequence from the upper left corner in the row direction every column. In this case, the nonvolatile memory 76 stores 16-bit binary data consisting of 8-bit correction factors and 8-bit temperature difference ranges in respective addresses.

In correspondence to the address table shown in FIG. 18A, data indicating the correction factors K=1.1, 1.2, 1.3, . . . , 1.5, 1.6 and the ranges of the temperature difference ΔT defined in FIG. 17B are stored respectively in areas of the addresses 28 to 40 of the nonvolatile memory 76 shown in FIG. 18B. Here, for example, as the data indicating the ranges of the temperature difference ΔT, values 6, 13,and 21 are employed to correspond to 5.5° C.≦ΔT<13.0° C., 13.0° C.≦ΔT<20.5° C., and over 20.5° C. respectively.

Actually the correction factors K=1.1 to 1.6 stored in the nonvolatile memory 76 shown in FIG. 18B are stored as the 8-bit binary data. FIG. 18C shows the actually used correction factors K stored in the nonvolatile memory 76. In this case, the correction factor K=1.0 is represented by the 8-bit binary data "10000000", i.e., "128" in a decimal system. Therefore, the correction factors K=1.1 to 1.6 shown in FIG. 18B are stored as the 8-bit binary data which correspond to the correction factors "141, 154, 166, . . . ,192, 205" in the decimal system.

For addressing of the nonvolatile memory 76 in FIG. 18C based on the external temperature To and the temperature difference ΔT in FIG. 18A, the address table shown in FIG. 18A may be provided in the correction factor deciding portion 74 in FIG. 16. However, in this embodiment, address values are described in the program to designate the addresses corresponding to the external temperature To. Such program is prepared for the CPU 36 which can achieve a function of the correction factor deciding portion 74. Preferably, since an access time can be reduced, the data should be transmitted from the EEPROM to the RAM at the time of turning-on of the power supply and then supplied from the RAM to the CPU.

Figure 19:
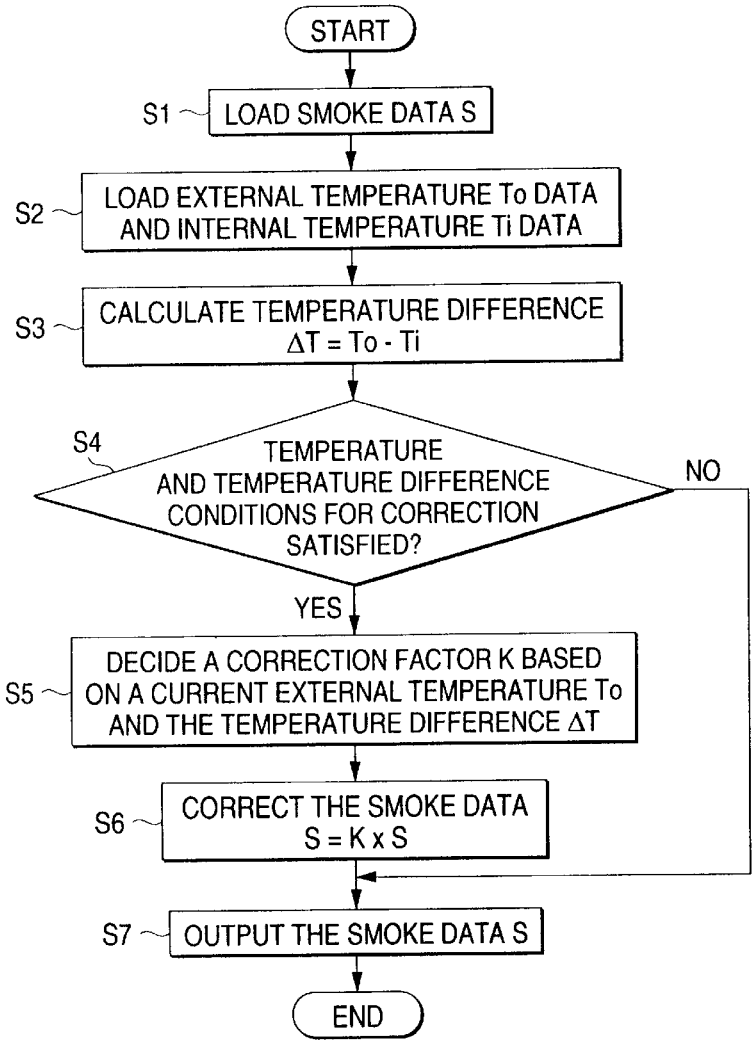
FIG. 19 is a flowchart for explaining fire detection process in FIG. 16.

FIG. 19 is a flowchart for explaining fire detection process of the multi-sensor processor 116 shown in FIG. 16. This fire detection process is repeated every constant process period based on an oscillation clock supplied from the oscillator circuit 42 to the CPU 36 in FIG. 14.

First, in step S1, the smoke data S which is converted into digital data by the A/D converter 70 is loaded. Then, in step S2, the external temperature To and the internal temperature Ti are loaded from the A/D converters 66, 68 respectively. Then, in step S3, the temperature difference ΔT is calculated as ΔT=To−Ti by the temperature difference calculator portion 72. Then, the process goes to step S4 where it is decided by the correction factor deciding portion 74 whether or not conditions for the external temperature To and the temperature difference ΔT to correct the smoke data are satisfied.

More particularly, the address corresponding to the temperature range, in which the external temperature To is contained at that time, can be decided in the program indicating the contents of the address table in FIG. 18A, and then the data of the correction factor K and the temperature difference ΔT can be read out from the nonvolatile memory 76. At this time, for example, if the external temperature To belongs to 13.0° C.≦ΔT<20.5° C., addresses 28, 29, 30 in FIG. 18B are designated and then three data are read out from the nonvolatile memory 76. Then, values 6, 13, 21 indicating the ranges of the temperature difference ΔT in the three read data are compared with the temperature difference ΔT at that time, and then the correction factor K in the corresponding range of the temperature difference ΔT is decided (step S5).

Subsequently, in step S6, the smoke data correction portion 78 can correct the smoke data S=K×S by multiplying the smoke data S being fetched from the A/D converter 70 by the decided correction factor K. Finally, in step S7, the corrected smoke data S is output.

On the contrary, in step S4, unless the conditions for the external temperature To and the temperature difference ΔT to correct the smoke data are satisfied, the processes in step S5 and S6 are skipped and then the smoke data S fetched from the A/D converter 70 is output as they are in step S7. More particularly, because the address of the nonvolatile memory 76 cannot be obtained by the correction factor deciding portion 74, the correction by the smoke data correction portion 78 is not performed and then the smoke data S fetched from the A/D converter 70 are output as they are.

In this manner, the correction factor K, which is increased larger if the external temperature To becomes higher and also the temperature difference ΔT indicating the rate of temperature rise becomes larger, can be decided based on the external temperature To at that time and the temperature difference ΔT indicating the rate of temperature rise, and then the smoke data can be corrected to enhance the smoke detection sensitivity. Therefore, even when the fire is caused like a flaming fire which seldom produces the smoke and rapidly increases the temperature, such flaming fire can be early detected from the smoke data without fail by increasing the smoke detection sensitivity.

In contrast, in the normal condition such that the fire sensor receives directly the hot air flow and the heat radiation from the space heater, the external temperature To is high but the temperature difference ΔT is small and also the temperature rise seldom appears. Therefore, in this case, the non-fire alarm can be prevented firmly by applying no correction to the smoke data.

Figure 20:
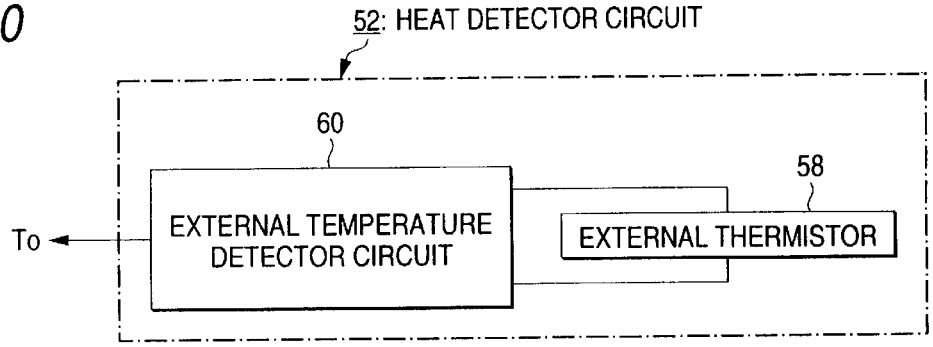
FIG. 20 is a block circuit diagram showing a heat detector circuit shown in FIG. 14 and having an external thermistor only.

FIG. 20 is a block circuit diagram showing a heat detector circuit 52 provided in the heat detector portion 28 in FIG. 14 according to another embodiment of the present invention. In the heat detector circuit 52 in the second embodiment of the present invention, only the external thermistor 58 is provided. The external temperature detector circuit 60 can output change in the resistance value of the external thermistor 58 due to the external temperature To to the CPU 36 as the external temperature To signal which is changed in response to the external temperature To.

Figure 21:
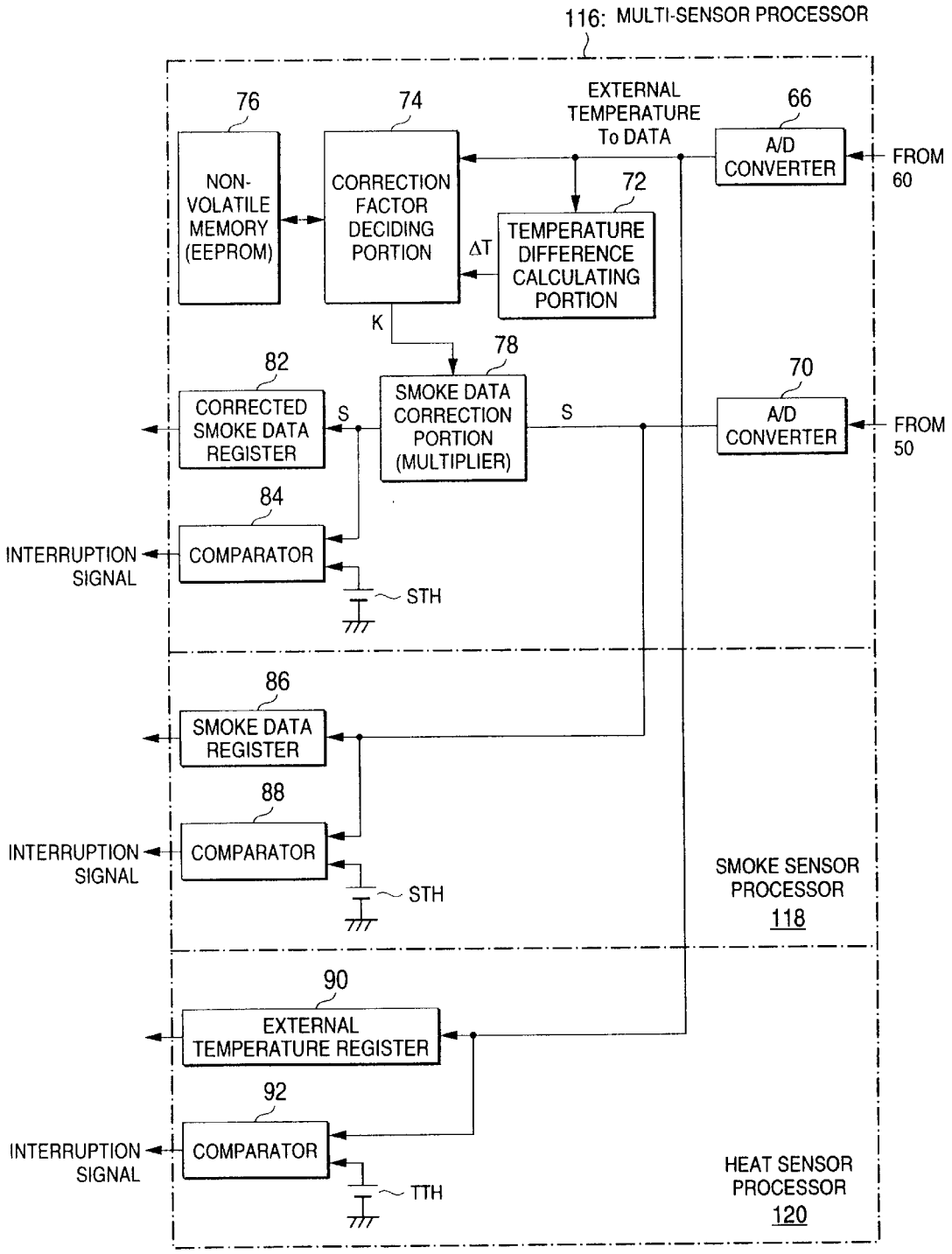
FIG. 21 is a functional block diagram showing a fire sensor according to a second embodiment of the present invention, which can be implemented by using the CPU shown in FIG. 14.

FIG. 21 is a functional block diagram showing a multi-sensor processor which are provided on the sensor side in FIG. 3 to correct the smoke detection sensibility based on the external temperature To signal from the heat detection circuit 52 in FIG. 20, a smoke sensor processor, and a heat sensor processor according to a second embodiment of the present invention. In the second embodiment, the external temperature To signal from the external thermistor provided in the heat detector circuit 52 in FIG. 20 and the smoke signal S from the light receiving amplifier circuit 50 provided in the smoke detector portion 30 in FIG. 14 are input into the CPU 36. However, unlike the first embodiment, the internal temperature Ti signal which is detected by the internal thermistor is not input.

The A/D converter 66 can receive the external temperature To every constant period, and then supply it to the temperature difference calculator portion 80 as a digital external temperature To. The temperature difference calculator portion 80 can calculate a pseudo output (reference temperature) of the temperature sensor with a larger time constant (this can be regarded as a sensor internal temperature). The temperature difference ΔT indicating the rate of temperature rise caused due to the fire is then calculated based on a difference between the external temperature To data and the reference temperature.

As another method, the temperature data values may be stored over a constant time in advance and then the rate of temperature rise may be calculated by dividing a difference between the data values by a time interval.

The correction factor deciding portion 74, the nonvolatile memory 76, and the smoke data correction portion 78 are similar to those in the first embodiment shown in FIG. 16. For example, the address is decided based on the external temperature To and the temperature difference ΔT in the address table in FIG. 18A, and then the correction factor K is decided by reading it from the nonvolatile memory 76 having the contents shown in FIG. 18C according to the decided address.

Figure 22:
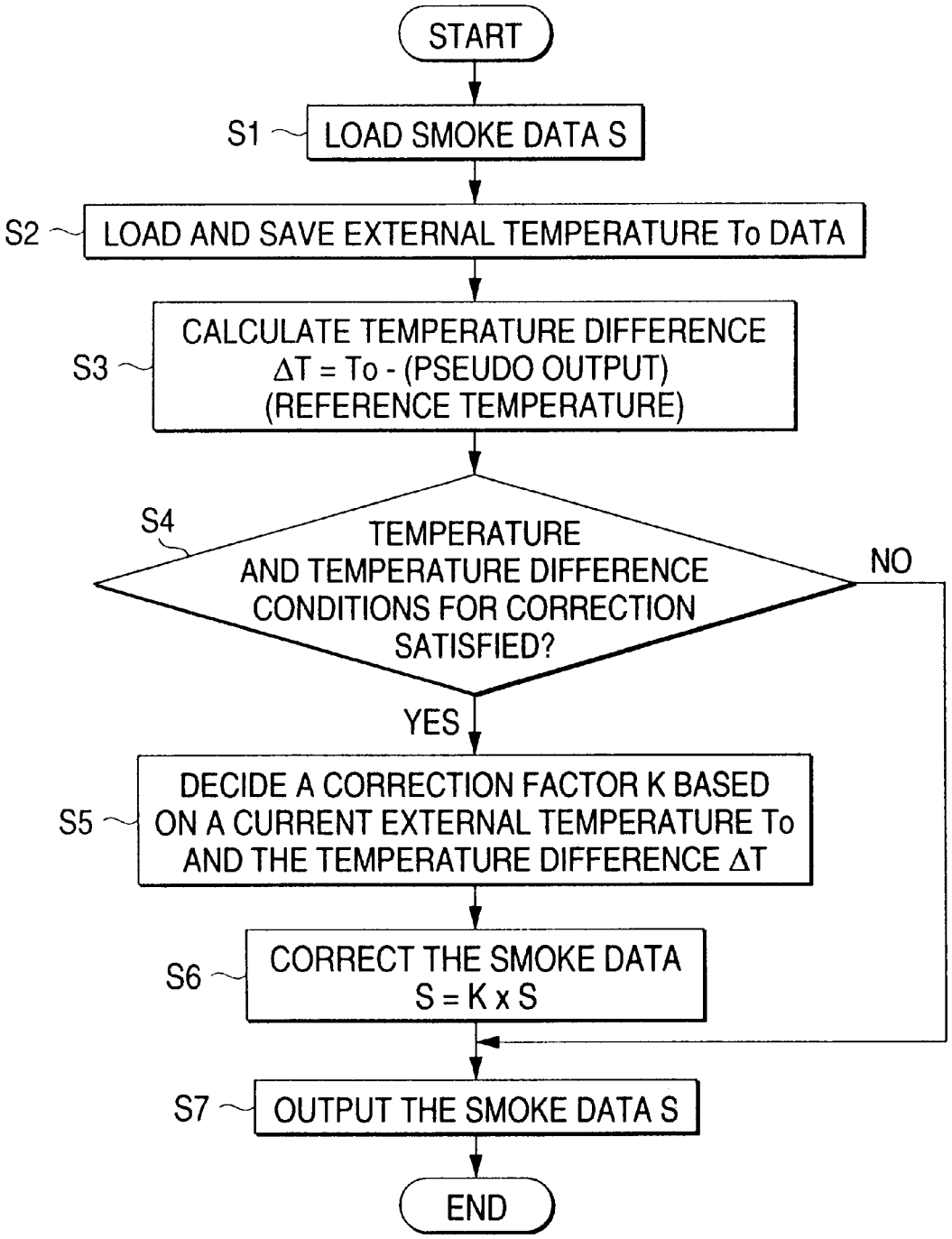
FIG. 22 is a flowchart for explaining process operation by a multi-sensor processor in FIG. 21.

FIG. 22 is a flowchart for explaining fire detection process effected by the multi-sensor processor 116 in FIG. 21 according to the second embodiment of the present invention. In the fire detection process of the second embodiment, the smoke data S is loaded in step S11, then the external temperature To is loaded and saved in step S12, and then the temperature difference calculator portion 80 calculates the temperature difference ΔT data as a difference between a pseudo output (reference temperature), which is regarded as the internal temperature of the sensor, and the external temperature To in step S13.

In turn, it is checked in step S14 whether or not the conditions for the external temperature To and the temperature difference ΔT to correction the smoke data are satisfied. If the conditions are satisfied in step S14, the correction factor K is decided based on the current external temperature To and the temperature difference ΔT in step S15. Then, the smoke data S is corrected as S=K X S by multiplying the smoke data S by the correction factor K in step S16. Then, corrected smoke data S is output in step S17. In contrast, unless the conditions for the external temperature To and the temperature difference ΔT to correction the smoke data are satisfied in step S14, processes in steps S15 and S16 are skipped and then the smoke data S are output as they are in step S17.

In the second embodiment in FIG. 21, if the external temperature To is high and the rate of temperature rise is large, the higher correction factor is decided based on two parameters, i.e., the external temperature To at that time and the temperature difference ΔT indicating the rate of temperature rise, and thus the smoke data are corrected so as to increase the smoke detection sensitivity. Therefore, even if the flaming fire in which the smoke is less generated and the temperature is rapidly increased is caused, the fire can be detected early without fail by correcting the smoke data.

In the situation that the fire sensor receives directly heat from the space heater with no generation of the smoke, the correction of the smoke data is not carried out since the temperature is high but the rate of temperature rise is small, so that the non-fire alarm issued by the space heater, etc. can be prevented surely.

Here, decision of the correction factor K which is employed to increase the smoke detection sensitivity based on two parameters of the external temperature and the temperature difference is not limited to the values of the correction factor decided by two temperature ranges in FIG. 17. The correction factor K may be appropriately decided within the range satisfying the condition that, if the external temperature is higher and the rate of temperature rise is larger, the correction factor must be decided to have a larger value. Of course, It this case, no correction is made in the ranges which have the causes other than the fire since the correction is not needed in such ranges.

Also, the correction factor K is changed in the range of K=1.1 to 1.6. However, appropriate values of the correction factor K to exceed 1.0 may be set as the case may be. In addition, if the value smaller than 1 is set as the correction factor K, the non-fire alarm issued due to the smoke can be prevented further surely.

Also, in the present invention, the classification is not limited to the temperature ranges of the external temperature To and the temperature difference ΔT shown in FIG. 17. However, the larger or smaller temperature ranges may be employed to have the smaller or larger division number if necessary. In addition, the numerical values per se may be varied.

In the above embodiment, the case where the smoke sensor and the heat sensor are provided to the fire sensor and the mode switching which corresponds to three data types of the multi-sensor mode, the smoke sensor mode, and the heat sensor mode is executed has been described as an example. But, the number of type of the sensors to be provided to the fire sensor may be selected appropriately.

Also, the mode switching process from the receiver may be selected appropriately in compliance with a monitoring algorithm which is applied plural types of data as monitoring objects. For example, as the monitoring algorithm, monitoring can be achieved by switching the mode appropriately, e.g., an algorithm by which the data in a particular mode are fixedly collected to monitor and data collection is switched into other modes when the fault is detected in the particular mode, an algorithm by which different types of data are monitored by switching the mode every polling period, etc.

In addition, appropriate variations are contained in the present invention not to damage the object and advantages of the present invention. Moreover, the present invention is not limited by the numerical values in the embodiments.

As described above, according to the present invention, the mode which decides type of the detection data responding to the receiver can be switched to the fire sensor which has a function of detecting plural types of data by a plurality of sensors. Hence, the centralized fire monitoring can be achieved while effectively utilizing a feature of data detection by a plurality of sensors, without switching of operations of the plurality of sensor portions by using the hardware and without reduction in the connection number of the fire sensors which is due to lack of the address caused when plural addresses corresponding to the type of data must be allocated to one fire sensor.

Especially, if a plurality of sensor circuits are always in their operation states and the fire or the fault is generated in a particular mode, the data can be quickly collected by other sensors without fail by switching the mode to send the data, so that fire decision or fault detection can be implemented with high reliability.

What is claimed is:

1. A fire monitoring system capable of detecting a fire by connecting a plurality of fire sensors to a receiver via a transmission line and then transmitting detection data from the plurality of fire sensors repeatedly in predetermined order in response to respective instructions issued from the receiver;

wherein each of the fire sensors comprises:

a plurality of sensor portions of different types;

sensor processors for outputting detection data of plural types, based on detection signals from the plurality of sensor portions; and a mode switching portion for switching a mode which corresponds to responding detection data in response to a mode switching instruction issued from the receiver, and sending selectively the detection data which corresponds to a current switched mode in response to a data request instruction issued from the receiver; and wherein the receiver comprises:

a mode switching indicating portion for switching the mode by transmitting the mode switching instruction which selects the mode of the detection data to the fire sensors, and a fire judging portion for judging the fire by receiving the detection data which is sent from the fire sensors in response to transmission of the data request instruction;

wherein said plural types of detection data include multi-sensor data which is corrected detection data from one of said plurality of sensor portions based on detection data from a remainder of the plurality of sensor portions.

2. The fire monitoring system according to claim 1, wherein the mode switching indicating portion of the receiver switches the mode of a particular fire sensor by designating the address of the particular fire sensor.

3. The fire monitoring system according to claim 1, wherein the mode switching indicating portion of the receiver switches the mode of all fire sensors by designating a polling address common to all fire sensors.

4. The fire monitoring system according to claim 1, wherein the mode switching indicating portion of the receiver switches a current mode which has fault into the other normal modes when it detects the fault in each of the fire sensors.

5. A fire monitoring system capable of detecting a fire by connecting a plurality of fire sensors to a receiver via a transmission line and then transmitting detection data from the plurality of fire sensors repeatedly in predetermined order in response to respective instructions issued from the receiver;

wherein each of the fire sensors comprises:

a plurality of sensor portions of different types;

sensor processors for outputting detection data of plural types, based on detection signals from the plurality of sensor portions; and a mode switching portion for switching a mode which corresponds to responding detection data in response to a mode switching instruction issued from the receiver, and sending selectively the detection data which corresponds to a current switched mode in response to a data request instruction issued from the receiver; and wherein the receiver comprises:

a mode switching indicating portion for switching the mode by transmitting the mode switching instruction which selects the mode of the detection data to the fire sensors, and a fire judging portion for judging the fire by receiving the detection data which is sent from the fire sensors in response to transmission of the data request instruction;

wherein each of the fire sensors includes, as the plurality of sensor portions, a smoke sensor portion for detecting a smoke generated by the fire to output a smoke signal, and a heat sensor portion for detecting heat radiated by the fire to output a temperature signal;

each of the fire sensors includes, as the sensor processors, a smoke sensor data processor for converting the smoke signal into smoke data responding to the receiver and then holding the smoke data, a temperature sensor data processor for converting the temperature signal into temperature data responding to the receiver and then holding the temperature data, and a multi-sensor data processor for correcting the smoke signal based on the temperature signal to convert the smoke signal into corrected smoke data responding to the receiver and then holding the corrected smoke data; and the mode switching portion has switching functions of a smoke sensor mode to send the smoke data, a temperature sensor mode to send the temperature data and a multi-sensor mode to send the corrected smoke data, and then switches the mode into one of the smoke sensor mode, the temperature sensor mode and the multi-sensor mode based on the mode switching instruction issued from the receiver.

6. The fire monitoring system according to claim 5, wherein the mode switching portion of each of the fire sensors sends data corresponding to a current switching mode when it receives the data request instruction not designating a particular mode from the receiver.

7. The fire monitoring system according to claim 5, wherein the mode switching portion of each of the fire sensors sends data in a designated mode irrespective of the current switching mode when it receives the data request instruction designating the particular mode from the receiver.

8. The fire monitoring system according to claim 5, wherein the mode switching portion of each of the fire sensors initializes the multi-sensor mode when the power supply is turned on.

9. The fire monitoring system according to claim 5, wherein each of the fire sensors further comprises an interruption processor for transmitting an interruption signal to the receiver when the smoke data, the temperature data or the corrected smoke data exceeds a predetermined threshold value; and the fire judging portion of the receiver transmits an interruption retrieval instruction so as to retrieve each of the fire sensors which has transmitted an interruption signal when it receives an interruption signal from each of the fire sensors and collects detection data sequentially by sending the data request instruction to a retrieved fire sensor repeatedly.

10. The fire monitoring system according to claim 5, wherein the multi-sensor data processor of each of the fire sensors includes:

a temperature difference detecting portion for detecting a temperature difference which represents a rate of temperature rise when it receives heat generated by the fire;

a correction factor deciding portion for deciding a correction factor for the smoke signal based on the external temperature and the temperature difference; and a smoke signal correcting portion for correcting the smoke signal by multiplying the smoke signal by the correction factor.

11. The fire monitoring system according to claim 10, wherein the correction factor deciding portion of the multi-sensor processing portion divides the external temperature and the temperature difference into a plurality of temperature ranges each having a predetermined temperature width respectively, then previously sets the correction factor to each temperature range of the temperature difference so as to increase substantially in proportion to an increase of the temperature difference if the external temperature belongs to a same temperature range, then previously sets the correction factor to each temperature range of the external temperature so as to increase substantially in proportion to rise of the external temperature if the temperature difference belongs to a same temperature range, and then decides a previously set correction factor based on the temperature range to which the external temperature detected by the external temperature detecting portion belongs and the temperature range to which the temperature difference calculated by the temperature difference calculating portion belongs.

12. The fire monitoring system according to claim 11, wherein the correction factor deciding portion of the multi-sensor processing portion varies the correction factor substantially by changing the temperature range of the external temperature and/or the temperature range of the temperature difference while fixing the previously set correction factor itself, otherwise varies the correction factor itself while fixing the temperature range of the external temperature and the temperature range of the temperature difference.

13. The fire monitoring system according to claim 11, wherein the correction factor deciding portion of the multi-sensor processing portion decides the correction factor of 1.0 and does not substantially correct the smoke signal by the smoke signal correcting portion if the external temperature is below a first predetermined temperature, if the temperature difference is below a first predetermined temperature difference, or if the external temperature is more than a second predetermined temperature and the temperature difference is less than a second predetermined temperature difference.

14. A fire sensor which is connected to a receiver via a transmission line and transmits detection data in response to an instruction issued from the receiver, comprising:

a plurality of sensor portions of different types;

a sensor processor for generating plural types of data based on the detection data from the plurality of sensor portions; and a mode switching portion for switching a mode which corresponds to the detection data in response to the receiver according to a mode switching instruction from the receiver, and sending selectively the data which corresponds to a current switching mode according to a data request instruction from the receiver;

wherein said plural types of data include multi-sensor data which is corrected detection data from one of said plurality of sensor portions based on detection data from a remainder of the plurality of sensor portions.

* * * * *